United States Patent [19]

Kume et al.

[11] Patent Number: 4,933,989

[45] Date of Patent: Jun. 12, 1990

[54] SILVER HALIDE COLOR PHOTOGRAPHIC MATERIAL

[75] Inventors: Yuji Kume; Keiji Mihayashi; Koji Tamoto; Mikio Ihama, all of Kanagawa, Japan

[73] Assignee: Fuji Photo Film Co.

[21] Appl. No.: 177,227

[22] Filed: Apr. 4, 1988

[30] Foreign Application Priority Data

Apr. 2, 1987 [JP] Japan ..... 62-81962

[51] Int. Cl.[5] ..... G03C 7/20; G03C 7/32

[52] U.S. Cl. ..... 430/505; 430/514; 430/548; 430/957

[58] Field of Search ..... 430/505, 544, 548, 957, 430/223, 554, 555, 558, 552, 553, 556, 557

[56] References Cited

U.S. PATENT DOCUMENTS

| | | | |
|---|---|---|---|
| 3,227,554 | 1/1966 | Barr et al. | 430/382 |
| 4,153,460 | 5/1979 | Iijima et al. | 430/505 |
| 4,438,193 | 3/1984 | Uemura et al. | 430/505 |
| 4,464,463 | 8/1984 | Kojima et al. | 430/512 |
| 4,618,571 | 10/1986 | Ichijima et al. | 430/505 |
| 4,652,516 | 3/1987 | Ichijima et al. | 430/544 |
| 4,698,297 | 10/1987 | Ichijima et al. | 430/544 |
| 4,737,451 | 4/1988 | Ichijima | 430/544 |
| 4,760,016 | 7/1988 | Hirabayashi et al. | 430/505 |
| 4,770,982 | 9/1988 | Ichijima et al. | 430/957 |
| 4,770,990 | 9/1988 | Nakamura et al. | 430/957 |
| 4,818,664 | 4/1989 | Ueda et al. | 430/505 |
| 4,824,772 | 4/1989 | Ichijima et al. | 430/544 |

FOREIGN PATENT DOCUMENTS

| | | |
|---|---|---|
| 0114675 | 1/1984 | European Pat. Off. . |
| 0157146 | 10/1985 | European Pat. Off. . |
| 61-42656 | 3/1986 | Japan . |
| 61-72236 | 8/1986 | Japan . |

*Primary Examiner*—Richard L. Schilling

[57] ABSTRACT

A silver halide color photographic material comprising a support having thereon at least one silver halide emulsion layer, wherein a silver halide emulsion contained in at least one of the silver halide emulsion layers is a silver halide emulsion in which 30% by number of the total number of whole silver halide grains have a diameter of not more than 0.3 μm, as a diameter of equivalent sphere, and the silver halide color photographic material contains a compound capable of releasing upon a reaction with an oxidation product of a developing agent a compound which is capable of releasing development inhibitor upon a reaction with another molecular of an oxidation product of a developing agent.

The silver halide color photographic material has excellent color reproducibility and sharpness as well as a broad exposure latitude.

36 Claims, 1 Drawing Sheet

SILVER HALIDE COLOR PHOTOGRAPHIC MATERIAL

FIELD OF THE INVENTION

The present invention relates to a silver halide color photographic material, and more particularly to a silver halide color photographic material which is excellent in color reproducibility and sharpness as well as having a broad exposure latitude.

BACKGROUND OF THE INVENTION

Recently, in the field of silver halide photographic materials, in particular those used for photography, photographic light-sensitive materials having super-high sensitivity as typically illustrated by ISO 1,600 films or those having high image quality (color reproducibility, sharpness) suitable for use in small format cameras as typically illustrated by 110 sized cameras such as disc cameras, in order to provide prints of high magnification of enlargement have been desired.

For the purpose of improving color reproducibility and sharpness, a method of improving color reproducibility by utilizing an interimage effect and of improving sharpness by utilizing an edge effect is known. In such methods, DIR compounds as described in U.S. Pat. No. 3,227,554, etc., more preferably diffusible DIR compounds as described in Japanese patent application (OPI) No. 7150/83 (the term "OPI" as used herein means a "published unexamined Japanese patent application"), etc. are employed.

On the other hand, in order to prevent contamination of a developing solution due to substances discharged from photographic light-sensitive materials during development or introduction of desensitizing substances from the developing solution into the photographic light-sensitive materials, the use of a light-insensitive fine grain silver halide emulsion has recently increased.

However, when a DIR compound is employed together with a fine grain silver halide emulsion, it is recognized that the interimage effect is severely decreased. There have been hitherto known a combination of a DIR compound and a light-sensitive silver halide fine grain as described in U.S. Pat. No. 4,153,460, a combination of a diffusible DIR compound incorporated into an emulsion layer and a light-insensitive silver halide fine grain, and a combination of a diffusible DIR compound incorporated into a light-insensitive layer and a light-insensitive silver halide fine grain. In any case, since DIR compounds are employed together with silver halide fine grains, the addition of a large amount of DIR compounds is necessary and it causes various subsidiary adverse affects, for example, an increase in layer thickness, etc.

It has also been desired to expand the exposure latitude in order to meet requirement for obtaining photographs of high image quality under various exposure conditions. For this purpose, the use of a light-sensitive fine grain silver halide emulsion has further increased. Consequently, the above described problem becomes more significant.

SUMMARY OF THE INVENTION

Therefore, an object of the present invention is to provide a silver halide color photographic material which is excellent in color reproducibility and sharpness and has extended exposure latitude.

Other objects of the present invention will become apparent from the following detailed description and examples.

It has now been found that these objects of the present invention can be attained by a silver halide color photographic material comprising a support having thereon at least one silver halide emulsion layer, wherein a silver halide emulsion contained in at least one of the silver halide emulsion layers is a silver halide emulsion in which 30% by number of the total number of whole silver halide grains have a diameter of not more than 0.3 μm, as a diameter of equivalent sphere, and the silver halide color photographic material contains a compound capable of releasing upon a reaction with an oxidation product of a developing agent a compound which is capable of releasing a development inhibitor upon a reaction with another molecule of an oxidation product of a developing agent.

BRIEF DESCRIPTION OF THE ACCOMPANYING DRAWINGS

FIG. 1 is a graph showing the characteristic curve, wherein Curve 1 denotes the characteristic curve of a yellow color image formed in a blue-sensitive layer, Curve 2 denotes a magenta color image density curve formed by uniform green light exposure in a green-sensitive layer, and Curve 3 denotes a theoretical magenta density curve formed by uniform green light exposure in the green-sensitive layer.

FIG. 2 is a graph showing the characteristic curve wherein Curve 1 denotes the characteristic curve of a cyan color image formed in a red-sensitive layer, Curve 2 denotes a yellow color image density curve formed by uniform blue light exposure in a blue-sensitive layer, and Curve 3 denotes a theoretical yellow density curve formed by uniform blue light exposure in the blue-sensitive layer.

DETAILED DESCRIPTION OF THE INVENTION

Figure 1:
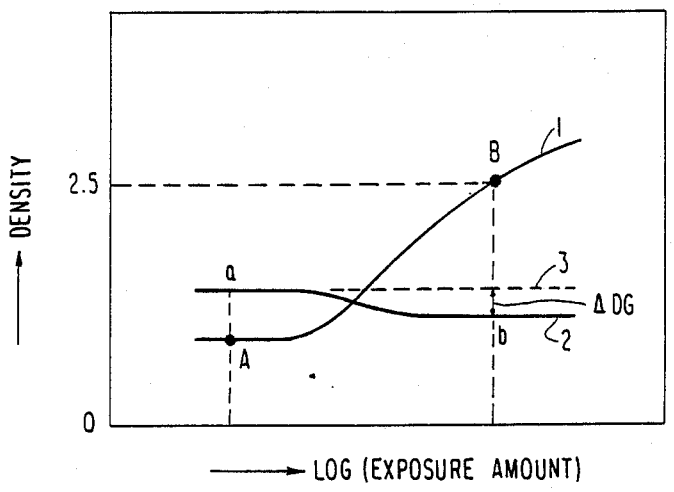

The silver halide emulsion according to the present invention is an emulsion having the grain-size distribution in that the maximum diameter of silver halide grain among a class of silver halide grains that take 30% by number of whole silver halide grains counted from the smallest is not more than 0.3 μm, as a diameter of equivalent sphere.

The term "diameter of silver halide grains" as used herein means a diameter corresponding to the projected area of silver halide grains obtained from microphotography of a silver halide emulsion using a well known method in the art (usually electron microscopic photography) as described in T. H. James, *The Theory of the Photographic Process,* Third Edition, pages 36 to 43 (1966). The diameter corresponding to the projected area of silver halide grains is defined as a diameter of a circle which has an area equal to the projected area of the silver halide grains as described in the above-mentioned literature. Therefore, the diameter of silver halide grain can be determined in the same manner as described above in the case of silver halide grains having a crystal structure other than a spherical structure, for example, a cubic, octahedral, tetradecahedral, tabular or potato-like structure, etc.

In the present invention, the maximum diameter of silver halide grain among a class of silver halide grains that take 30% by number of whole silver halide grains counted from the smallest is not more than 0.3 μm, as a diameter of equivalent sphere. The maximum diameter is preferably not more than 0.25 μm, more preferably not more than 0.2 μm, and further more preferably not more than 0.17 μm, as a diameter of equivalent sphere.

Further, the maximum diameter of the silver halide grains is not more than 0.3 μm, as a diameter of equivalent sphere, in the class of silver halide grains that generally take 30% by number, preferably 40% by number, and more preferably 50% by number, of whole silver halide grains counted from the smallest.

Silver halide grains in the silver halide emulsion may have a regular crystal structure (normal crystal grains), for example, a hexahedral, octahedral, dodecahedral of tetradecahedral structure, etc., or an irregular crystal structure, for example, a spherical, potato-like or tabular structure, etc.

The amount of the silver halide emulsion to be added is generally not more than 0.1 $g/m^2$ calculated as metallic silver. However, in order to avoid the occurrence of problems such as degradation of desilvering property, etc., due to an increase in the amount of silver, it is preferably from 0.15 to 5.0 $g/m^2$, more preferably from 0.2 to 4.0 $g/m^2$, and further more preferably from 0.3 to 3.0 $g/m^2$.

The above described silver halide emulsion may or may not be light-sensitive. It is preferred to add the silver halide emulsion to a layer containing a compound which denotes an interimage effect, a layer which accepts the interimage effect or a layer positioned between these layers.

More specifically, in the color photographic materials of the present invention, the above-described silver halide emulsion may be present in a light-sensitive layer containing a compound capable of releasing upon a reaction with an oxidation product of a developing agent a compound which is capable of releasing a development inhibitor upon a reaction with another molecule of an oxidation product of a developing agent (hereinafter referred to as layer A), a layer having the same color sensitivity as layer A but having different sensitivity with layer A, a light-sensitive layer having different color sensitivity with layer A, or a light-insensitive layer which is positioned between a light-sensitive layer nearest to a support and a light-sensitive layer farthest to the support.

With respect to the halogen composition of the silver halide grains, it is preferred to contain 60 mol % or more silver bromide and up to 10 mol % silver chloride. Further, more preferred silver halide grains are those containing from 0 to 10 mol % silver iodide, particularly from 0 to 4 mol % silver iodide.

The silver halide emulsion used in the present invention can be prepared by various processes including a neutral process, a semi-ammonia process, an ammonia process, etc. Further, various preparation systems, such as a double jet process, a conversion process, etc., can be employed.

The silver halide grains may or may not be chemically sensitized. Further, they may or may not be spectrally sensitized.

The above described silver halide emulsion and other silver halide emulsions used in the present invention can be prepared using known methods, for example, those described in *Research Disclosure* (*RD*), No. 17643 (Dec., 1978), pages 22 to 23, "I. Emulsion Preparation and Types" and *RD*, No. 18716 (November, 1979), page 648, P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964), etc.

Monodispersed emulsions described in U.S. Pat. Nos. 3,574,628 and 3,655,394, British Pat. No. 1,413,748, etc., are preferably used in the present invention.

Further, tabular silver halide grains having an aspect ratio of about 5 or more can be employed in the present invention. The tabular grains may be easily prepared by the method described in Gutoff, *Photographic Science and Engineering*, Vol. 14, pages 248 to 257 (1970), U.S. Pat. Nos. 4,434,226, 4,414,310, 4,433,048 and 4,439,520, British Pat. No. 2,112,157, etc.

Crystal structure of silver halide grains may be uniform, composed of different halide compositions between the inner portion and the other portion, or may have a stratified structure.

Further, silver halide emulsions in which silver halide grains having different compositions are connected upon epitaxial junctions or silver halide emulsions in which silver halide grains are connected with compounds other than silver halide such as silver thiocyanate, lead oxide, etc. may also be employed.

Moreover, a mixture of grains having different crystal structures may be used.

The silver halide emulsions used in the present invention are usually subjected to physical ripening, chemical ripening and spectral sensitization. Various kinds of additives which can be employed in these steps are described in *RD*, No. 17643 (December, 1978) and *RD*, No. 18716 (November, 1979) and the pertinent items thereof are summarized in the table shown below.

Further, known photographic additives which can be used in the present invention are also described in the above mentioned literature and the pertinent items thereof are summarized in the table below.

| No. | Kind of Additives | RD 17643 | RD 18716 |
|---|---|---|---|
| 1. | Chemical Sensitizers | Page 23 | Page 648, right column |
| 2. | Sensitivity Increasing Agents | | Page 648, right column |
| 3. | Spectral Sensitizers and Supersensitizers | Pages 23 to 24 | Page 648, right column to page 649, right column |
| 4. | Whitening Agents | Page 24 | — |
| 5. | Antifoggants and Stabilizers | Pages 24 to 25 | Page 649, right column |
| 6. | Light-Absorbers, Filter Dyes and Ultraviolet Ray Absorbers | Pages 25 to 26 | Page 649, right column to page 650, left column |
| 7. | Antistaining Agents | Page 25, right column | Page 650, left column to right column |
| 8. | Dye Image Stabilizers | Page 25 | — |
| 9. | Hardening Agents | Page 26 | Page 651, left column |

-continued

| No. | Kind of Additives | RD 17643 | RD 18716 |
|---|---|---|---|
| 10. | Binders | Page 26 | Page 651, left column |
| 11. | Plasticizers and Lubricants | page 27 | Page 650, right column |
| 12. | Coating Aids and Surfactants | Pages 26 to 27 | Page 650, right column |
| 13. | Antistatic Agents | Page 27 | Page, 650, right column |

The present invention can be applied to a multilayer multicolor color photographic material having at least two spectral sensitivities. A multilayer multicolor color photographic material generally contains on a support at least one red-sensitive emulsion layer, at least one green-sensitive emulsion layer, and at least one blue-sensitive emulsion layer. The arrangement of these emulsion layers can properly be selected depending on the object of the photographic material. A preferable arrangement of the layers is from the support side a red-sensitive emulsion layer, a green-sensitive emulsion layer, and a blue-sensitive emulsion layer in order. In addition, the photographic material of the present invention may contain two or more of the same color sensitive emulsion layers which have different sensitivities to increase the sensitivity.

In order to improve the graininess, the photographic material may contain three of the same color sensitive emulsion layers which have different sensitivities. Further, a light-insensitive layer may be present between the same color sensitive emulsion layers. An emulsion layer may be present between any other color sensitive emulsion layers.

Furthermore, a filter layer absorbing light of a specific wavelength or a antihalation layer may be contained in the multilayer multicolor photographic materials. These light-absorption layers can contain fine particulate collords as well as organic dyes.

Generally, a red-sensitive emulsion layer contains a cyan dye-forming coupler, a green-sensitive emulsion layer contains a magenta dye-forming coupler, and a blue-sensitive emulsion layer contains a yellow dye-forming coupler. Of course, other combinations may be taken if necessary. For example, for applying to similar color photography or semiconductor laser beams, a combination of infrared-sensitive layers may be employed. Further, the light-sensitive layer may contain a coupler other than a coupler forming color to the additive complementary colors to remove unnatural color, as disclosed in Japanese Patent Publication No. 3481/58.

The compound capable of releasing upon a reaction with an oxidation product of a developing agent a compound which is capable of releasing a development inhibitor upon a reaction with another molecule of an oxidation product of a developing agent used in the present invention can be represented by the following general formula (I):

$$A—PDI \qquad (I),$$

wherein A represents a group capable of releasing PDI upon a reaction with an oxidation product of a developing agent; and PDI represents a group which forms a development inhibitor through a reaction with an oxidation product of a developing agent after being released from A.

The compounds represented by the general formula (I) are described in detail below.

Of the compounds represented by the general formula (I) according to the present invention, preferred compounds are represented by the following general formula (II):

$$A—(L_1)_v—B—(L_2)_w—DI \qquad (II),$$

wherein A represents a group capable of releasing $(L_1)_v$—B—$(L_2)_w$—DI upon a reaction with an oxidation product of a developing agent; $L_1$ represents a group capable of releasing B—$(L_2)_2$—DI after being released from A; B represents a group capable of releasing $(L_2)_w$—DI upon a reaction with an oxidation product of a developing agent after being released from A—$(L_1)_v$; $L_2$ represents a group capable of releasing DI after being released from B; DI represents a development inhibitor; and v and w each represents 0 or 1.

The reaction process upon which the compound represented by the general formula (II) releases DI at the time of development can be represented by the following schematic formulae:

$$A—(L_1)_v—B—(L_2)_w—DI \xrightarrow{T^{\oplus}} (L_1)_v—B—(L_2)_w—DI \longrightarrow$$

$$B—(L_2)_w—DI \xrightarrow{T^{\oplus}} (L_2)_w—DI \longrightarrow DI$$

wherein A, $L_1$, B, $L_2$, DI, v and w each has the same meaning as defined in the general formula (II) above; and $T^{\oplus}$ represents an oxidation product of a developing agent.

In the above described reaction formulae, the excellent effect according to the present invention is characterized by the reaction of forming $(L_2)_w$—DI from B—$(L_2)_w$—DI. Specifically, this reaction is a second order reaction between $T^{\oplus}$ and B—$(L_2)_w$—DI and the rate of reaction depends on the concentration of each reactant. Therefore, B—$(L_2)_w$—DI immediately releases $(L_2)_w$—DI in a region where $T^{\oplus}$'s generate in a large amount. In contrast therewith, in a region where $T^{\oplus}$'s generate only in a small amount, B—$(L_2)_w$—DI releases $(L_2)_w$—DI slowly. Such a reaction process coupled with the above described reaction processes reveals effectively the function of DI.

Now, the compound represented by the general formula (II) is described in greater detail below.

In general formula (II), A specifically represents a coupler residual group or an oxidation reduction group.

When A represents a coupler residual group, any known coupler residual group can be utilized. Suitable examples thereof include a yellow coupler residual group (for example, an open-chain ketomethylene type coupler residual group, etc.), a magenta coupler residual group (for example, a 5-pyrazolone type coupler residual group, a pyrazoloimidazole type coupler residual group, a pyrazolotriazole type coupler residual group, etc.), a cyan coupler residual group (for example, a phenol type coupler residual group, a naphthol type coupler residual group, etc.), and a non-color forming coupler residual group (for example, an indanone type coupler residual group, an acetophenone type coupler residual group, etc.), etc. Further, the coupler residual groups described in U.S. Pat. Nos. 4,315,070, 4,183,752, 4,171,223 and 4,226,934, etc., are also useful.

When A represents an oxidation reduction group, the group is specifically represented by the following general formula (III):

$$A_1—P—(X{=}Y)_n—Q—A_2 \qquad \text{(III)},$$

wherein P and Q each represents an oxygen atom or a substituted or unsubstituted imino group; at least one of n X's and n Y's represents a methine group having a group of $—(L_1)_v—B—(L_2)_w—DI$ as a substituent, and other X's and Y's each represent a substituted or unsubstituted methine group or a nitrogen atom; n represents an integer from 1 to 3 (N X's and n Y's may be the same or different); $A_1$ and $Z_2$ each represents a hydrogen atom or a group capable of being eliminated with an alkali; and any two substituents of P, X, Y, Q, $A_1$ and $A_2$ may be divalent groups and connected with each other to form a cyclic structure.

Examples of the cyclic structure include a benzene ring or a pyridine ring, etc., formed by $(X{=}Y)_n$.

In general formula (II), the groups represented by $L_1$ and $L_2$ may or may not be used depending on the purpose. Preferred examples of the groups represented by $L_1$ and $L_2$ include known linking groups described below.

(1) A group utilizing a cleavage reaction of hemiacetal

Examples of these groups include those as described, for example, in U.S. Pat. No. 4,146,396, Japanese patent application (OPI) Nos. 249148/85 and 249149/85, etc., and are represented by the following general formula (T-1):

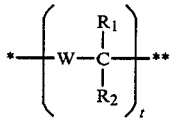

(T-1)

wherein a bond indicated by * denotes the position at which the group is connected to the left side group in the general formula (II); a bond indicated by ** denotes the position at which the group is connected to the right side group in the general formula (II); W represents an oxygen atom, a sulfur atom or a group of

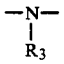

(wherein $R_3$ represents an organic substituent); $R_1$ and $R_2$ each represents a hydrogen atom or a substituent; t represents 1 or 2, when t represents 2, two $R_1$'s and two $R_2$'s may be the same or different; and any two of $R_1$, $R_2$ and $R_3$ may combine with each other to form a cyclic structure such as 5- to 7-membered ring.

The organic substituents represented by $R_3$ include an alkyl group (e.g., methyl group, ethyl group, etc.), an aryl group (e.g., phenyl group, naphthyl group, etc.), a sulfonyl group, a carbonyl group, a sulfamoyl group, a carbamoyl group, etc.

The substituents represented by $R_1$ and $R_2$ include a methyl group, an ethyl group, an n-butyl group, etc.

Specific examples of the groups represented by the general formula (T-1) are set forth below.

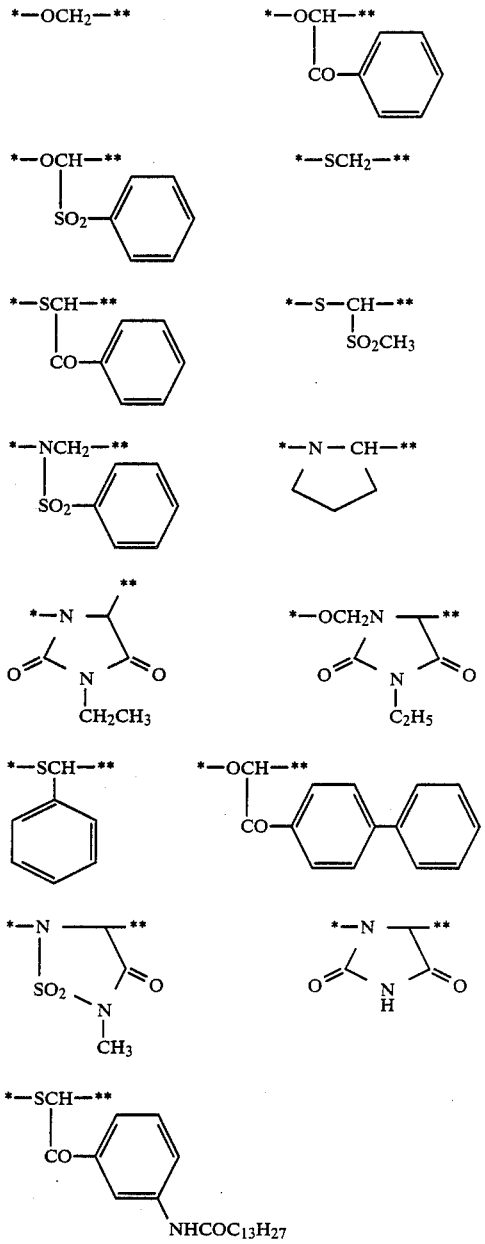

(2) A group causing a cleavage reaction utilizing an intramolecular nucleophilic displacement reaction Examples of these groups include the timing groups described in U.S. Pat. No. 4,248,962, etc., and are represented by the following general formula (T-2):

$$*—NU—Link—E—** \qquad \text{(T-2)}$$

wherein a bond indicated by * denotes the position at which the group is connected to the left side group in the general formula (II); a bond indicated by  denotes the position at which the group is connected to the right side group in the general formula (II); Nu represents a nucleophilic group including, for example, an oxygen atom or a sulfur atom, etc.; E represents an electrophilic group which is able to cleave the bond indicated by  upon a nucleophilic attack of Nu; and Link represents a linking group which connects Nu with E in a stereochemical position capable of causing an intramolecular nucleophilic displacement reaction between Nu and E.

Specific examples of the groups represented by general formula (T-2) ar set forth below.

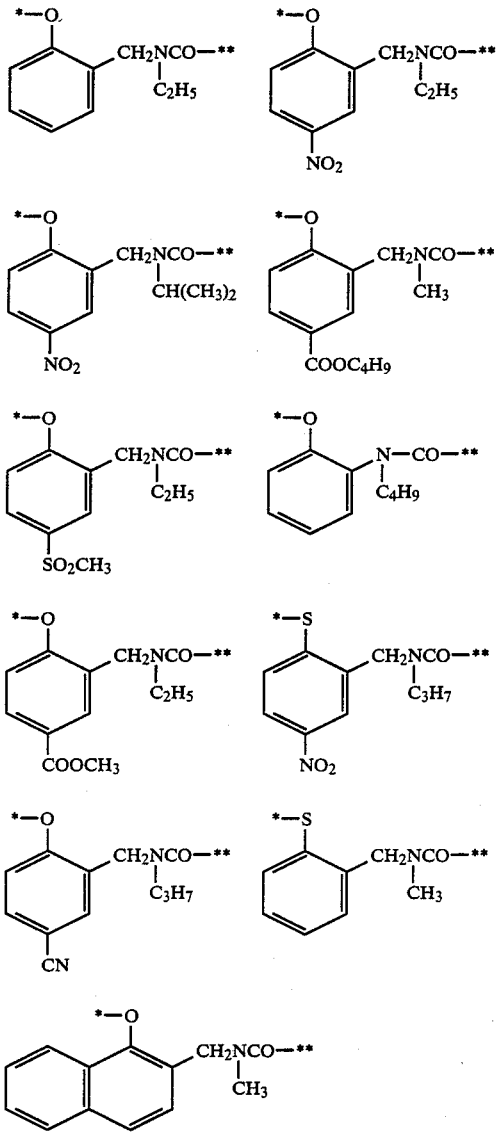

(3) A group causing a cleavage reaction utilizing an electron transfer reaction via a conjugated system Examples of these groups include those as described in U.S. Pat. Nos. 4,409,323 and 4,421,845, and are represented by the following general formula (T-3):

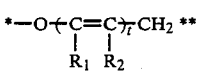

(T-3)

wherein a bond indicated by *, a bond indicated by **, $R_1$, $R_2$ and t each has the same meaning as defined in general formula (T-1) above.

Specific examples of the groups represented by general formula (T-3) are set forth below.

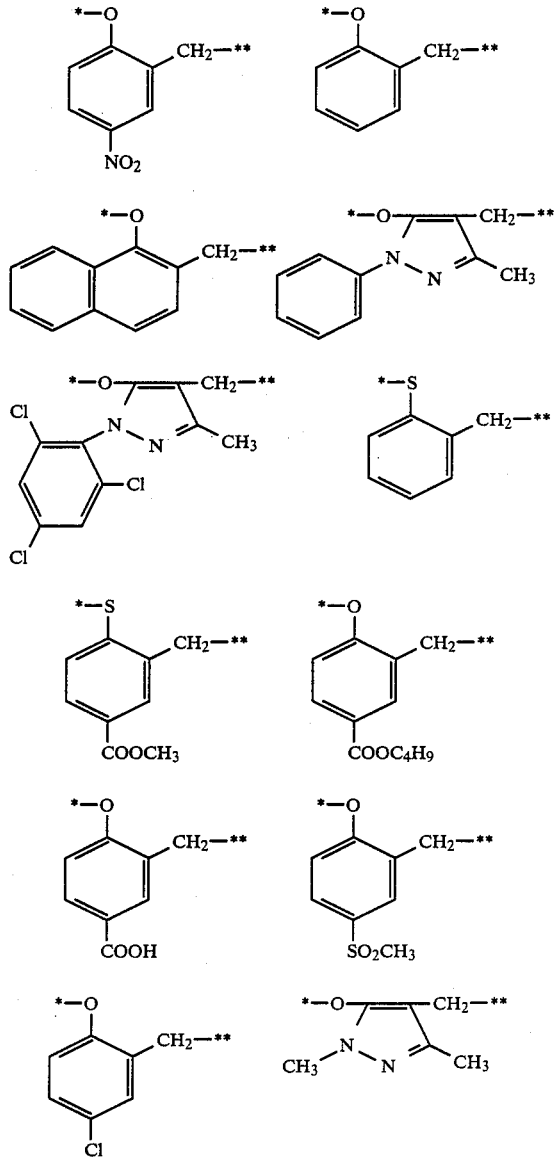

(4) A group utilizing a cleavage reaction of an ester upon hydrolysis

Examples of these groups include those described in West German patent application (OLS) No. 2,626,315, etc., and are specifically represented by the following formulae:

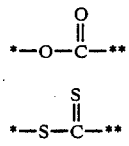

wherein a bond indicated by * and a bond indicated by ** each has the same meaning as defined in general formula (T-1) above.

In general formula (II), the group represented by B is specifically a group capable of forming a coupler after being released from $A—(L_1)_v$ or a group capable of forming an oxidation reduction group after being released from $A—(L_1)_v$. Examples of groups forming a coupler include a group which is formed by eliminating a hydrogen atom from a hydroxy group of a phenol type coupler and is connected to $A—(L_1)_v$ at the oxygen atom of the hydroxy group, and a group which is formed by eliminating a hydrogen atom from a hydroxy group of a 5-hydroxypyrazole which is a tautomer of a 5-pyrazolone type coupler and is connected to $A—(L_1)_v$ at the oxygen atom of the hydroxy group. In these cases, the group forms a phenol type coupler or a 5-pyrazolone type coupler for the first time after being released from $A—(L_1)_v$. These couplers have $(L_2)_w—DI$ at their coupling position.

When B represents a group capable of forming an oxidation-reduction group, B is preferably represented by the following general formula (B-1):

$$*—P(X'=Y')_n—Q—A_2 \qquad \text{(B-1)}$$

wherein a bond indicated by * denotes the position at which the group is connected to $A—(L_1)_v—$; $A_2$, P, Q and n each has the same meaning as defined as general formula (III); at least one of n X''s and Y''s represents a methine group having a group of $(L_2)_w—DI$ as a substituent, and other X''s and Y''s each represent a substituted or unsubstituted methine group or a nitrogen atom; and any two substituents of $A_2$, P, Q, X' and Y' may be divalent groups and may combine with each other to form a cyclic structure.

When a cyclic structure is formed by any two substituents of $A_2$, P, Q, X' and Y', it is preferably a 5-, 6-or 7-membered ring and a 6-membered ring is particularly preferred.

In general formula (II), the group represented by DI specifically includes a tetrazolylthio group, a benzimidazolylthio group, a benzothiazolylthio group, a benzoxazolylthio group, a benzotriazolyl group, a benzindazolyl group, a triazolylthio group, an imidazolylthio group, a thiadiazolylthio group, a thioether-substituted triazolyl group (for example, the development inhibitors described in U.S. Pat. No. 4,579,816, etc.), and an oxadiazolyl group, etc., and these groups may have one or more appropriate substituents.

Representative examples of such substituents include a halogen atom, an aliphatic group, an alicyclic group, a nitro group, an acylamino group, an aliphatic or alicyclic oxycarbonyl group, an aromatic oxycarbonyl group, an imido group, a sulfonamido group, an aliphatic or alicyclic oxy group, an aromatic oxy group, an amino group, an imino group, a cyano group, an aromatic group, an acyloxy group, a sulfonyloxy group, an aliphatic or alicyclic thio group, an aromatic thio group, an aromatic oxysulfonyl group, an aliphatic or alicyclic oxysulfonyl group, an aliphatic or alicyclic oxycarbonylamino group, an aromatic oxycarbonylamino group, an aliphatic or alicyclic oxycarbonyloxy group, a heterocyclic oxycarbonyl group, a heterocyclic oxy group, a sulfonyl group, a acyl group, a ureido group, a heterocyclic group, a hydroxy group, etc. In the above described substituents, the total number of carbon atoms included therein is preferably 20 or less.

Of the above substituents, the heterocyclic moiety of the heterocyclic oxycarbonyl group, the heterocyclic oxy group, and the heterocyclic group may, for example, be a hetero ring containing one or more nitrogen atoms, oxygen atoms or sulfur atoms as ring members.

In general formula (II), any two groups represented by A, $L_1$, B, $L_2$, and DI may have a bond in addition to the bond represented in the general formula (II) and may be connected with each other. In such cases, even when the second bond is not cleaved at the time of development, the effect of the present invention can be achieved. Examples of compounds including such a second bond are represented by the following general formulae:

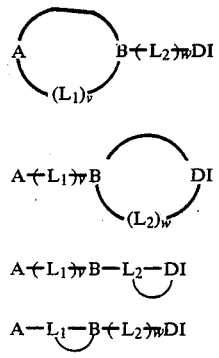

wherein A, $L_1$, B, $L_2$, DI, v and w each as the same meaning as defined in general formula (II) above.

The compounds represented by general formula (II) used in the present invention include compounds which are polymers. That is, the compound may be a polymer derived from a monomer compound represented by general formula (P-1) described below and having a recurring unit represented by general formula (P-2) described below or may be a copolymer of the above described monomer compound and at least one non-color forming monomer containing at least one ethylene group which does not have an ability to couple with an oxidation product of an aromatic primary amine developing agent. In this case, two or more kinds of the monomer compounds may be simultaneously polymerized.

$$CH_2=\overset{R}{\overset{|}{C}}(A_2)_l(A_3)_j(A_1)_kQ \qquad \text{(P-1)}$$

$$\left(CH_2-\overset{R}{\overset{|}{\underset{\underset{(A_2)_l(A_3)_j(A_1)_kQ}{|}}{C}}}\right) \qquad \text{(P-2)}$$

wherein R represents a hydrogen atom, a lower alkyl group having from 1 to 4 carbon atoms or a chlorine atom; $A_1$ represents —CONH—, —NHCONH—, —NHCOO—, —COO—, $—SO_2—$, —CO—, —NHCO—, $—SO_2NH—$, $—NHSO_2—$, —OCO—, —OCONH—, —S—, —NH— or —O—; $A_2$ represents —CONH— or —COO—; $A_3$ represents a substituted or unsubstituted alkylene group having from 1 to 10 carbon atoms, a substituted or unsubstituted aralkylene group, or a substituted or unsubstituted arylene group.

The alkylene group may be a straight chain or branched chain alkylene group. Examples of the alkylene group include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group include a benzylidene group, etc. Examples of the arylene group include a phenylene group, a naphthylene group, etc.

Q is the above described general formulae represents a residual group of the compound represented by general formula (II) and may be bonded through any moiety of A, $L_1$, B and $L_2$ in general formula (II).

Further, i, j and k each represents 0 or 1 excluding the case that i, j, and k are simultaneously 0.

Examples of substituents for the alkylene group, aralkylene group or arylene group represented by $A_3$ include an aryl group (e.g., a phenyl group, etc.), a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., a fluorine atom, a chlorine atom, a bromine atom, etc.), a carboxy group, a carbamoyl group (e.g., a methylcarbamoyl group, etc.), an alkoxycarbonyl group (e.g., a methoxycarbonyl group, etc.), a sulfonyl group (e.g., a methylsulfonyl group, etc.), etc. When the group represented by $A_3$ has two or more substituents, they may be the same or different.

Examples of non-color forming ethylenic monomers which do not cause coupling with the oxidation product of an aromatic primary amine developing agent include an acrylic acid such as acrylic acid, α-chloroacrylic acid, α-alkylacrylic acid, etc., an ester or amide derived from an acrylic acid, methylenebisacrylamide, a vinyl ester, an acrylonitrile, an aromatic vinyl compound, a maleic acid derivative, a vinylpyridine, etc. In this case, two or more of such non-color forming ethylenically unsaturated monomers can be used together with.

Of the compounds according to the present invention, preferred compounds are explained in detail below.

In the case where A represents a coupler residual group of general formula (I) or (II), preferred coupler residual groups include those represented by general formula (Cp-1), (Cp-2), (Cp-3), (Cp-4), (Cp-5), (Cp-6), (Cp-7), (Cp-8) or (Cp-9) described below. These coupler residual groups are preferred because of their high coupling rates.

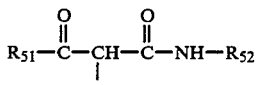
(Cp-1)

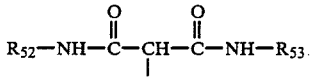
(Cp-2)

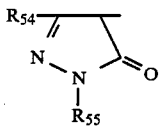
(Cp-3)

-continued

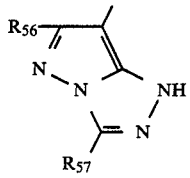
(Cp-4)

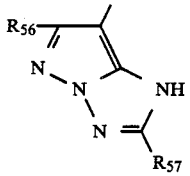
(Cp-5)

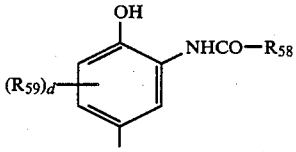
(Cp-6)

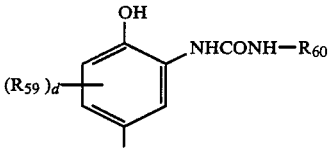
(Cp-7)

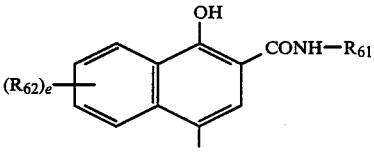
(Cp-8)

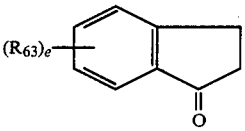
(Cp-9)

In the above-described formulae, a free bond attached to the coupling position indicates a position to which a group capable of being released upon coupling is bonded.

When $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ in the above-described general formulae contains a diffusion-resistant group, it is selected so that the total number of carbon atoms included therein is from 8 to 40 and preferably from 10 to 30. In other cases, the total number of carbon atoms included therein is preferably not more than 15. In cases of bis type, telomer type or polymer type couplers, any of the above-described substituents forms a divalent group and may connect to a repeating unit, etc. In such cases, the total number of carbon atoms can be outside of the above-described range.

Now, $R_{51}$ to $R_{63}$, d and e in the above-described general formulae (Cp-1) to (Cp-9) are explained in detail. In the following, $R_{41}$ represents an aliphatic group, an alicyclic group, an aromatic group or a heterocyclic group; $R_{42}$ represents an aromatic group or a heterocyclic group; and $R_{43}$, $R_{44}$ and $R_{45}$ each represents a hydrogen atom, an aliphatic group, an alicyclic group, an aromatic group or a heterocyclic group.

$R_{51}$ represents a group as defined for $R_{41}$.

$R_{52}$ and $R_{53}$ each represents a group as defined for $R_{42}$.

$R_{54}$ represents a group as defined for $R_{41}$, a group of $$R_{41}\underset{\underset{R_{43}}{|}}{CON}-,$$

a group of $$R_{41}\underset{\underset{R_{43}}{|}}{N}-,$$

a group of $$R_{41}SO_2\underset{\underset{R_{43}}{|}}{N}-,$$

a group of $R_{41}S$—, a group of $R_{43}O$—, a group of $$R_{45}\underset{\underset{R_{43}}{|}}{N}C\underset{\underset{R_{44}}{|}}{O}N-,$$

a group of $R_{41}OOC$—, a group of $$R_{44}\underset{\underset{R_{43}}{|}}{N}CO-$$

or a group of N≡C—.

$R_{55}$ represents a group as defined for $R_{41}$.

$R_{56}$ and $R_{57}$ each represents a group as defined for $R_{43}$, a group of $R_{41}S$—, a group of $R_{41}O$—, a group of $$R_{41}\underset{\underset{R_{43}}{|}}{CON}-,$$

a group of $$R_{41}\underset{\underset{R_{43}}{|}}{N}-,$$

a group of $$R_{43}\underset{\underset{R_{44}}{|}}{N}C\underset{\underset{R_{45}}{|}}{O}N-$$

or a group of $$R_{41}SO_2\underset{\underset{R_{43}}{|}}{N}-.$$

$R_{58}$ represents a group as defined for $R_{41}$.

$R_{59}$ represents a group as defined for $R_{41}$, a group of $$R_{41}\underset{\underset{R_{43}}{|}}{CON}-,$$

a group of $$R_{41}O\underset{\underset{R_{43}}{|}}{CON}-,$$

a group of $$R_{41}SO_2\underset{\underset{R_{43}}{|}}{N}-,$$

a group of $$R_{43}\underset{\underset{R_{44}}{|}}{N}C\underset{\underset{R_{45}}{|}}{O}N-,$$

a group of $$R_{43}\underset{\underset{R_{44}}{|}}{N}SO_2\underset{\underset{R_{45}}{|}}{N}-,$$

a group of $R_{41}O$—, a group of $R_{41}S$—, a halogen atom or a group of $$R_{41}\underset{\underset{R_{43}}{|}}{N}-.$$

d represents an integer from 0 to 3. When d represents 2 or more, two or more $R_{59}$'s may be the same or different. Further, each of two $R_{59}$'s may be a divalent group and connected with each other to form a cyclic structure.

Examples of the divalent groups for forming a cyclic structure include a group of

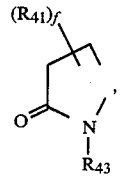

a group of

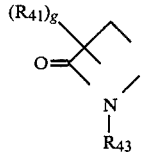

or a group of

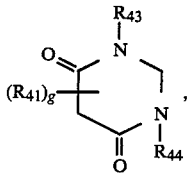

wherein f represents an integer of from 0 to 4; and g represents an integer of from 0 to 2.

$R_{60}$ represents a group as defined for $R_{41}$.

$R_{61}$ represents a group as defined for $R_{41}$.

$R_{62}$ represents a group as defined as $R_{41}$, a group of $R_{41}CONH$—, a group of $R_{41}OCONH$—, a group of $R_{41}SO_2NH$—, a group of $$R_{43}\underset{R_{44}}{N}C\underset{R_{45}}{N}O-,$$

a group of $$R_{43}\underset{R_{44}}{N}SO_2\underset{R_{45}}{N}-,$$

a group of $R_{43}O$—, a group of $R_{41}S$—, a halogen atom or a group of $$R_{41}\underset{R_{43}}{N}-.$$

$R_{63}$ represents a group as defined for $R_{41}$, a group of $$R_{41}C\underset{R_{44}}{N}O-,$$

a group of $$R_{41}\underset{R_{44}}{N}CO-,$$

a group of $$R_{41}SO_2\underset{R_{44}}{N}-,$$

a group of $$R_{41}\underset{R_{44}}{N}SO_2-,$$

a group of $R_{41}SO$—, a group of $R_{41}OCO$—, a group of $R_{41}OSO_2$—, a halogen atom, a nitro group, a cyano group or a group of $R_{43}CO$—.

e represents an integer of from 0 to 4. When e represents 2 or more, two or more $R_{62}$'s or $R_{63}$'s may be the same or different.

The aliphatic group referred to above is an aliphatic hydrocarbon group having from 1 to 32 carbon atoms, preferably from 1 to 22 carbon atoms, and may be saturated or unsaturated, a straight-chain or branched chain, and substituted or unsubstituted. Representative examples of the unsubstituted aliphatic group include a methyl group, an ethyl group, a propyl group, an isopropyl group, a butyl group, a tert-butyl group, an isobutyl group, a tert-amyl group, a hexyl group, a 2-ethylhexyl group, an octyl group, a 1,1,3,3-tetramethylbutyl group, a decyl group, a dodecyl group, a hexadecyl group, or an octadecyl group, etc.

The alicyclic group referred to above is an alicyclic hydrocarbon group having from 1 to 32 carbon atoms, preferably from 1 to 22 carbon atoms, and may be saturated or unsaturated and substituted or unsubstituted. A representative example of the unsubstituted alicyclic group is a cyclohexyl group.

The aromatic group referred to above is an aromatic group having from 6 to 20 carbon atoms, and preferably an unsubstituted or substituted phenyl group or an unsubstituted or substituted naphthyl group.

The heterocyclic group described above is a heterocyclic group having from 1 to 20 carbon atoms, preferably from 1 to 7 carbon atoms and containing at least one of a nitrogen atom, an oxygen atom and a sulfur atom, as a hetero atom, and preferably a three-membered to eight-membered, substituted or unsubstituted heterocyclic group. Representative examples of the unsubstituted heterocyclic group include a 2-pyridyl group, a 4-pyridyl group, a 2-thienyl group, a 2-furyl group, a 2-imidazolyl group, a pyrazinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-3-yl group, a succinimido group, a phthalimido group, a 1,2,4-triazol-2-yl group, or a 1-pyrazolyl group, etc.

The aliphatic group, alicyclic group, aromatic group and heterocyclic group may have one or more substituents as described above. Representative examples of substituents include a halogen atom, a group of $R_{47}O$—, a group of $R_{46}S$—, a group of $$R_{47}C\underset{R_{48}}{N}O-,$$

a group of $$R_{47}\underset{R_{48}}{N}CO-,$$

a group of $$R_{46}OC\underset{R_{47}}{N}O-,$$

a group of $$R_{46}SO_2\underset{R_{47}}{N}-,$$

a group of $R_{47}NSO_2$—, (with $R_{48}$)

a group of $R_{46}SO_2$—, a group of $R_{47}OCO$—, a group of $R_{47}NCON$—, ($R_{48}$, $R_{49}$)

a group of $R_{46}$—, a group of

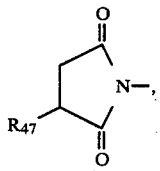

a group of $R_{46}COO$—, a group of $R_{47}OSO_2$—, a cyano group, or a nitro group, etc. In the above described formulae, $R_{46}$ represents a aliphatic group, an alicyclic group, an aromatic group or a heterocyclic group; and $R_{47}$, $R_{48}$ and $R_{49}$ each represents a hydrogen atom, an aliphatic group, an alicyclic group, an aromatic group or a heterocyclic group. The aliphatic group, alicyclic group, aromatic group and heterocyclic group each has the same meaning as defined above.

Preferred scopes of $R_{51}$ to $R_{63}$, d and e are described below.

$R_{51}$ is preferably an aliphatic group, an alicyclic group or an aromatic group.

$R_{52}$, $R_{53}$ and $R_{55}$ each is preferably an aromatic group.

$R_{54}$ is preferably a group of $R_{41}CONH$— or group of $R_{41}$—N—. ($R_{43}$)

$R_{56}$ and $r_{57}$ each is preferably an aliphatic group, an alicyclic group, a group of $R_{41}O$— or a group of $R_{41}S$—.

$R_{58}$ is preferably an aliphatic group, an alicyclic group or an aromatic group.

$R_{59}$ in general formula (Cp-6) is preferably a chlorine atom, an aliphatic group, a alicyclic group or a group of $R_{41}CONH$—.

d in general formula (Cp-6) is preferably 1 or 2.

$R_{60}$ is preferably an aromatic group.

$R_{59}$ in general formula (Cp-7) is preferably a group of $R_{41}CONH$—.

d in general formula (Cp-7) is preferably 1.

$R_{61}$ is preferably an aliphatic group, an alicyclic group or an aromatic group.

e in general formula (Cp-8) is preferably 0 or 1.

$R_{62}$ is preferably a group of $R_{41}OCONH$—, a group of $R_{41}CONH$— or a group of $R_{41}SO_2NH$—. The position of $R_{62}$ is preferably the 5-position of the naphthol ring.

$R_{63}$ is preferably a group of $R_{41}CONH$—, a group of $R_{41}SO_2NH$—, a group of $R_{41}NSO_2$—, ($R_{43}$)

a group of $R_{41}SO_2$—, a group of $R_{41}NCO$, ($R_{43}$)

a nitro group or a cyano group.

e in general formula (Cp-9) is preferably 1 or 2.

Representative examples of $R_{51}$ to $R_{63}$ are set forth below.

Examples of $R_{51}$ include a tert-butyl group, a 4-methoxyphenyl group, a phenyl group, a 3-[2-(2,4-di-tertamylphenoxy)butanamido]phenyl group, a 4-octadecyloxyphenyl group or a methyl group, etc.

Examples of $R_{52}$ and $R_{53}$ include a 2-chloro-5-dedecyloxycarbonylphenyl group, a 2-chloro-5-hexadecylsulfonamidophenyl group, a 2-chloro-5-tetradecanamidophenyl group, a 2-chloro-5-[4-(2,4-di-tert-amylphenoxy)butanamido]phenyl group, a 2-chloro-5-[2-(2,4-di-tert-amylphenoxy)butanamido] phenyl group, a 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro5-octyloxycarbonylphenyl group, a 2,4-dichlorophenyl group, a 2-chloro-5-(1-dodecyloxycarbonylethoxycarbonyl)phenyl group, a 2-chlorophenyl group, or a 2-ethoxyphenyl group, etc.

Examples of $R_{54}$ include a 3-[2-(2,4-di-tert-amylphenoxybutanamido]benzamido group, a 3-[4-(2,4-di-tert-amylphenoxy)butanamido]benzamido group, a 2-chloro-5-tetradecanamidoanilino group, a 5-(2,4-di-tert-amylphenoxyacetamido)benzamido group, a 2-chloro-5-dodecenylsuccinimidoanilino group, a 2-chloro-5-[2-(3-tert-butyl-4-hydroxyphenoxy)tetradecanamido]anilino group, a 2,2-dimethylpropanimido group, a 2-(3-pentadecylphenoxy)butanamido group, a pyrrolidino group, or an N,N-dibutylamino group, etc.

Examples of $R_{55}$ include a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-tert-amylphenoxy)butanamido]phenyl group, or a 2,6-dichloro-4-methanesulfonylphenyl group, etc.

Examples of $R_{56}$ include a methyl group, an ethyl group, an isopropyl group, a methoxy group, an ethoxy group, a methylthio group, an ethylthio group, a 3-phenylureido group, a 3-butylureido group, or a 3-(2,4-di-tert-amylphenoxy)propyl group, etc.

Examples of $R_{57}$ include a 3-(2,4-di-tert-amylphenoxy)propyl group, a 3-[4-{2-[4-(4-hydroxyphenylsulfonyl)phenoxy]tetradecanamido}phenyl]propyl group, a methoxy group, an ethoxy group, a methylthio group, an ethylthio group, a methyl group, a 1-methyl-2-{2-octyloxy-5-[2-octyloxy-5-(1,1,3,3-tetramethylbutyl)-phenylsulfonamido]phenylsulfonamido}ethyl group, a 3-[4-(4-dodecyloxyphenylsulfonamido)phenyl]propyl group, a 1,1-dimethyl-2-[2-octyloxy-5-(1,1,3,3-tetramethylbutyl)phenylsulfonamido]ethyl group, or a dodecylthio group, etc.

Examples of $R_{58}$ include a 2-chlorophenyl group, a pentafluorophenyl group, a heptafluoropropyl group, a 1-(2,4-di-tert-amylphenoxy)propyl group, a 3-(2,4-di-tertamylphenoxy)propyl group, a 2,4-di-tert-amylmethyl group, or a furyl group, etc.

Examples of $R_{59}$ include a chlorine atom, a methyl group, an ethyl group, a propyl group, a butyl group, an isopropyl group, a 2-(2,4-di-tert-amylphenoxy)-butanamido group, a 2-(2,4-di-tert-amylphenoxy)hexanamido group, a 2-(2,4-di-tert-octylphenoxy)octanamido group, a 2-(2-chlorophenoxy)tetradecanamido group, a 2,2-dimethylpropanamido group, a 2-[4-(4-hydroxyphenylsulfonyl)phenoxy]tetradecanamido group, or a 2-[2-(2,4-di-tert-amylphenoxyacetamido)phenoxy]butanamido group, etc.

Examples of $R_{60}$ include a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, or a 3-methoxycarbonylphenyl group.

Examples of $R_{61}$ include a dodecyl group, a hexadecyl group, a cyclohexyl group, a butyl group, a 3-(2,4-di-tertamylphenoxy)propyl group, a 4-(2,4-di-tert-amylphenoxy)butyl group, a 3-dodecyloxypropyl group, a 2-tetradecyloxyphenyl group, a tert-butyl group, a 2-(2-hexyldecyloxy)phenyl group, a 2-methoxy-5-dodecyloxycarbonylphenyl group, a 2-butoxyphenyl group, or a 1-naphthyl group, etc.

Examples of $R_{62}$ include an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, a trifluoroacetamido group, a 3-phenylureido group, a butoxycarbonylamino group, or an acetamido group, etc.

Examples of $R_{63}$ include a 2,4-di-tert-amylphenoxyacetamido group, a 2-(2,4-di-tert-amylphenoxy)-butanamido group, a hexadecylsulfonamido group, an N-methyl-N-octadecylsulfamoyl group, an N,N-dioctylsulfamoyl group, a dodecyloxycarbonyl group, a chlorine atom, a fluorine atom, a nitro group, a cyano group, a N-3-(2,4-di-tert-amylphenoxy)propylsulfamoyl group, a methanesulfonyl group, or a hexadecylsulfonyl group, etc.

When A in general formula (III) represents a group of general formula (III), a preferred scope of the group is described below.

When P and Q each represents a substituted or unsubstituted imino group, an imino group substituted with a sulfonyl group or an acyl group is preferred. In such a case, P or Q is represented by the following general formula (N-1) or (N-2):

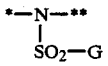

(N-1)

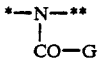

(N-2)

wherein a bond indicated by * denotes the position at which the group is connected to $A_1$ or $A_2$; a bond indicated by ** denotes the position at which the group is connected to one of the free bonds of $-(X{=}Y)_n-$; and G represents an aliphatic or alicyclic group containing from 1 to 32 carbon atoms, preferably from 1 to 22 carbon atoms, which may be straight chain or branched chain, saturated or unsaturated, and substituted or unsubstituted (for example, a methyl group, an ethyl group, a benzyl group, a phenoxybutyl group, an isopropyl group, etc.), an alicyclic group containing from 1 to 32 carbon atoms, preferably from 1 to 22 carbon atoms, which may be saturated or unsaturated and substituted or unsubstituted (for example, a cyclopentyl group, a 4-methylcyclohexyl group, etc.), a substituted or unsubstituted aromatic group containing from 6 to 10 carbon atoms (for example, a phenyl group, a 4-methylphenyl group, a 1-naphthyl group, a 4-dodecyloxyphenyl group, etc.) or a 4-membered to 7-membered heterocyclic group containing, as a hetero atom, a nitrogen atom, a sulfur atom or an oxygen atom (for example, a 2-pyridyl group, a 1-phenyl-4-imidazolyl group, a 2-furyl group, a benzothienyl group, etc.).

When $A_1$ and $A_2$ each represents a group capable of being eliminated with an alkali (hereinafter referred to as a precursor group), preferred examples of such precursor groups include a hydrolyzable group, for example, an acyl group, an alkoxycarbonyl group, an aryloxycarbonyl group, a carbamoyl group, an imidoyl group, an oxazolyl group, a sulfonyl group, etc.; a precursor group of a type utilizing a reversal Michel reaction as described in U.S. Pat. No. 4,009,029, etc.; a precursor group of a type utilizing an anion generated after a ring cleavage reaction as an intramolecular nucleophilic group as described in U.S. Pat. No. 4,310,612, etc.; a precursor group utilizing an electron transfer of an anion via a conjugated system whereby a cleavage reaction occurs as described in U.S. Pat. Nos. 3,674,478, 3,932,480 and 3,993,661, etc.; a precursor group utilizing an electron transfer of an anion reacted after a ring cleavage reaction whereby a cleavage reaction occurs as described in U.S. Pat. No. 4,335,200; or a precursor group utilizing an imidomethyl group as described in U.S. Pat. Nos. 4,363,865 and 4,410,618, etc.

In general formula (III), it is preferred that P represents an oxygen atom and $A_2$ represents a hydrogen atom.

It is more preferred that in general formula (III), X and Y each represents a substituted or unsubstituted methine group, except that at least one of X or Y represents a methine group having a group of $-(L_1)_v-B-(L_2)_w-DI$ as a substituent.

Of the groups represented by general formula (III), those particularly preferred are represented by the following general formula (IV) or (V):

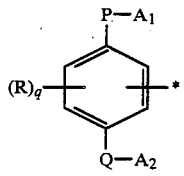

(IV)

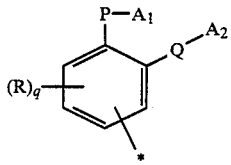

(V)

wherein a bond indicated by group denotes the position at which the group is connected to $-(L_1)_v-B-(L_2)_w-DI$; P, Q, $A_1$ and $A_2$ each has the same meaning as defined in general formula (III); R represents a substituent; q represents an integer of 0, 1, 2 or 3; and when q represents 2 or 3, two or three R's may be the same or different, or when two R's represent substituents positioned on the adjacent two carbon atoms, they may be divalent groups and connected to each other to form a cyclic structure.

Examples of the cyclic structures formed by condensing the benzene ring and another ring include a naphthalene ring, a benzonorbornene ring, a chroman ring, an indole ring, a benzothiophene ring, quinoline ring, a benzofuran ring, a 2,3-dihydrobenzofuran ring, an indane ring, an indene ring, etc. These rings may further have one or more substituents.

Preferred examples of the substituents represented by R and the substituents on the condensing ring described above include an aliphatic group (for example, a methyl group, an ethyl group, an allyl group, a benzyl group, a dodecyl group, etc.), an alicyclic group, an aromatic group (for example, a phenyl group, a naphthyl group, a 4-phenoxycarbonylphenyl group, etc.), a halogen atom (for example, a chlorine atom, a bromine atom, etc.), an alkoxy group (for example, a methoxy group, a hexadecyloxy group, etc.), an alkylthio group (for example, a methylthio group, a dodecylthio group, a benzylthio group, etc.), an aryloxy group (for example, a phenyl group, a 4-tert-octylphenoxy group, a 2,4-di-tert-amylphenoxy group, etc.), an arylthio group (for example, a phenylthio group, a 4-dodecyloxyphenylthio group, etc.), a carbamoyl group (for example, an N-ethylcarbamoyl group, an N-propylcarbamoyl group, an N-hexadecylcarbamoyl group, an N-tert-butylcarbamoyl group, an N-3-(2,4-di-tertamylphenoxy)propylcarbamoyl group, an N-methyl-N-octadecylcarbamoyl group, etc.), an alkoxycarbonyl group (for example, a methoxycarbonyl group, a 2-cyanoethoxycarbonyl group, an ethoxycarbonyl group, a dodecyloxycarbonyl group, a 3-(2,4-di-tert-amylphenoxy)propoxycarbonyl group, etc.), an aryloxycarbonyl group (for example, a phenoxycarbonyl group, a 4-nonylphenoxycarbonyl group, etc.), a sulfonyl group (for example, a methanesulfonyl group, a benzenesulfonyl group, a p-toluenesulfonyl group, etc.), a sulfamoyl group (for example, an N-propylsulfamoyl group, an N-methyl-N-octadecylsulfamoyl group, an N-phenylsulfamoyl group, an N-dodecylsulfamoyl group, etc.), an acylamino group (for example, an acetamido group, a benzamido group, a tetradecanamido group, a 4-(2,4-di-tert-amylphenoxy)butanamido group, a 2-(2,4-ditert-amylphenoxy)butanamido group, a 2-(2,4-di-tert-amylphenoxy)tetradecanamido group, etc.), a sulfanamido group (for example, a methanesulfanamido group, a benzenesulfanamido group, a hexadecylsulfanamido group, etc.), an acyl group (for example, an acetyl group, a benzoyl group, a myristoyl group, a palmitoyl group, etc.), a nitroso group, an acyloxy group (for example, an acetoxy group, a benzoyloxy group, an lauryloxy group, etc.), a ureido group (for example, a 3-phenylureido group, a 3-(4-cyanophenyl)ureido group, etc.), a nitro group, a cyano group, a heterocyclic group (preferably a 4-membered, 5-membered or 6-membered heterocyclic group containing a nitrogen atom, an oxygen atom or a sulfur atom as a hetero atom, for example, a 2-furyl group, a 2-pyridyl group, a 1-imidazolyl group, a 1-morpholino group, etc.), a hydroxy group, a carboxy group, an alkoxycarbonylamino group (for example, a methoxycarbonylamino group, a phonoxycarbonylamino group, a dodecyloxycarbonylamino group, etc.), a sulfo group, an amino group, an arylamino group (for example, an anilino group, a 4-methoxycarbonylanilino group, etc.), an aliphatic amino group (for example, an N,N-diethylamino group, a dodecylamino group, etc.), an alicyclic amino group, a sulfinyl group (for example, a benzenesulfinyl group, a propylsulfinyl group, etc.), a sulfamoylamino group (for example, a 3-phenylsulfamoylamino group, etc.), a thioacyl group (for example, a thiobenzoyl group, etc.), a thioureido group (for example, a 3-phenylthioureido group, etc.), a heterocyclic thio group (for example, a thiadiazolylthio group, etc.), an imido group (for example, a succinimido group, a phthalimido group, an octadecenylimido group, etc.), or a heterocyclic amino group (for example, a 4-imidazolylamino group, a 4-pyridylamino group, etc.), etc.

The aliphatic moiety included in the above described substituents may have from 1 to 32 carbon atoms, preferably from 1 to 20 carbon atoms, and may be a straight chain or branched chain, saturated or unsaturated, substituted or unsubstituted aliphatic group.

The alicyclic moiety included in the above described substituents may have from 1 to 32 carbon atoms, preferably from 1 to 20 carbon atoms, and may be a saturated or unsaturated, substituted or unsubstituted alicyclic group.

The aromatic moiety included in the above described substituents may have from 6 to 10 carbon atoms and is preferably a substituted or unsubstituted phenyl group.

The heterocyclic moiety included in the above described substituents may be a 5-, 6- or 7-membered ring containing a nitrogen atom, an oxygen atom or a sulfur atom as a hetero atom.

It is preferred that the group represented by B in general formula (II) is a group represented by general formula (B-1).

In general formula (B-1), P preferably represents an oxygen atom and Q preferably represents an oxygen atom or one of the following groups:

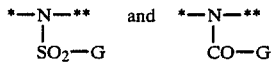

wherein a bond indicated by * denotes the position at which the group is connected to $-(X'=Y')_n-$; a bond indicated by ** denotes the position at which the group is connected to $A_2$; and G has the same meanings as defined in general formula (N-1) or (N-2).

Further, the effects of the present invention are particularly exhibited when the group represented by B in general formula (II) represents a group represented by the following general formula (B-2) or (B-3):

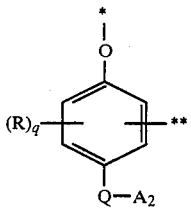

(B-2)

-continued (B-3)

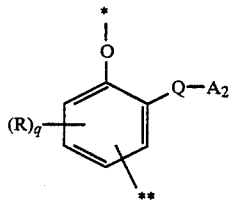

wherein a bond indicated by * denotes the position at which the group is connected to A—$(L_1)_v$—; a bond indicated by ** denotes the position at which the group is connected to —$(L_2)_w$—DI; and R, q, Q and $A_2$ each has the same meanings as defined in general formula (IV) or (V).

Preferred examples of the substituents represented by R in general formula (B-2) or (B-3) include an aliphatic group (for example, a methyl group, an ethyl group, etc.), an alicyclic group, an alkoxy group (for example, a methoxy group, an ethoxy group, etc.), an alkylthio group (for example, a methylthio group, an ethylthio group, etc.), an alkoxycarbonyl group (for example, a methoxycarbonyl group, a propoxycarbonyl group, etc.), an aryloxycarbonyl group (for example, a phenoxycarbonyl group, etc.), a carbamoyl group (for example, an N-propylcarbamoyl group, a N-tertbutylcarbamoyl group, an N-ethylcarbamoyl group, etc.), a sulfonamido group (for example, a methanesulfonamido group, etc.), an acylamino group (for example, an acetamido group, etc.), a heterocyclic thio group which may, for example, have hetero atoms selected from a nitrogen atom, an oxygen atom and a sulfur atom (for example, a tetrazolylthio group, etc.), a hydroxy group, or an aromatic group, etc. It is preferred that the total number of carbon atoms included in the above described group for R is not more than 15.

In general formula (II), it is preferred that both v and w are 0.

It is particularly preferred that the group represented by A in general formula (II) is a coupler residual group.

In the following, more preferred embodiments according to the present invention are described.

In general formula (II), a particularly preferred example of the development inhibitor represented by DI is a development inhibitor which is a compound having a development inhibiting function when being released as DI and capable of being decomposed (or changed into) a compound having substantially no effect on photographic properties after being discharged into a color developing solution.

Examples of these development inhibitors include those as described in U.S. Pat. No. 4,477,563, Japanese patent application (OPI) Nos. 218644/85, 221750/85, 233650/85 and 11743/86, etc.

Preferred examples of the development inhibitors represented by DI include those represented by the following general formula (D-1), (D-2), (D-3), (D-4), (D-5), (D-6), (D-7), (D-8), (D-9), (D-10) or (D-11):

(D-1)

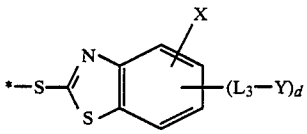

-continued (D-2)

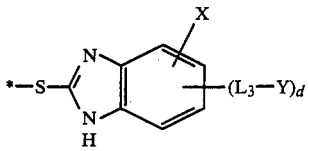

(D-3)

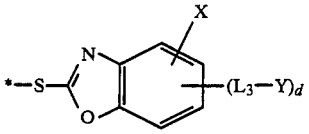

(D-4)

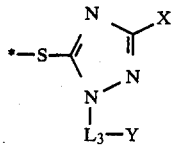

(D-5)

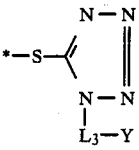

(D-6)

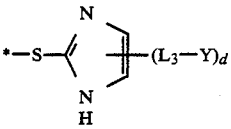

(D-7)

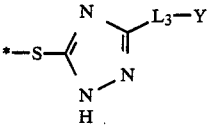

(D-8)

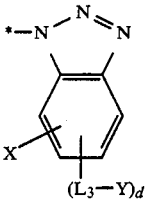

(D-9)

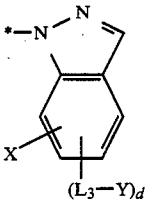

(D-10)

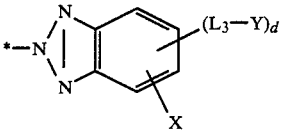

(D-11)

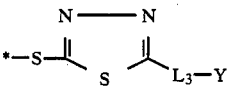

wherein a bond indicated by group denotes the position at which the group is connected to $A—(L_1)_v—B—(L_2)_w—$; X represents a hydrogen atom or a substituent; d represents 1 or 2; $L_3$ represents a group containing a chemical bond which is capable of being cleaved in a developing solution; and Y represents a substituent capable of generating the development inhibiting function and is selected from an aliphatic group, an alicyclic group, an aromatic group or a heterocyclic group.

The development inhibitor represented by DI described above which is released from $A—(L_1)_v—B—(L_2)_w—$, diffuses in a photographic layer while exercising the development inhibiting function and a part thereof discharges into the color developing solution. The development inhibitor discharged into the color developing solution rapidly decomposes at the chemical bond included in $L_3$ to release the group represented by Y (for example, hydrolysis of an ester bond) upon a reaction with a hydroxyl ion or hydroxylamine generally present in the color developing solution, whereby the compound changes into a compound having a large water-solubility and a small development inhibiting function, and thus the development inhibiting function substantially disappears.

While X in the above described formulae is preferably a hydrogen atom, it may be a substituent. Representative examples of the substituent include a aliphatic group (for example, a methyl group, an ethyl group, etc.), an alicyclic group, an acylamino group (for example, an acetamido group, a propionamido group, etc.), an alkoxy group (for example, a methoxy group, an ethoxy group, etc.), a halogen atom (for example, a chlorine atom, a bromine atom, etc.), a nitro group, or a sulfonamido group (for example, a methanesulfonamido group, etc.), etc.

The linking group represented by $L_3$ in the above described general formulae includes a chemical bond which is cleaved in a developing solution. Suitable examples of such chemical bonds include those described in the table below. These chemical bonds are cleaved with a nucleophilic reagent such as a hydroxyl ion or hydroxylamine, etc., which is a component of the color developing solution.

TABLE

| Chemical Bond Included in $L_3$ | Cleavage Reaction of Chemical Bond (Reaction with $^{\ominus}OH$) |
|---|---|
| $—COO—$ | $—COOH + HO—$ |
| $—NHCOO—$ | $—NH_2 + HO—$ |
| $—SO_2O—$ | $—SO_3H + HO—$ |
| $—OCH_2CH_2SO_2—$ | $—OH + CH_2{=}CHSO_2—$ |
| $—\underset{\underset{O}{\|}}{C}O—$ | $—OH + HO—$ |
| $—NH\underset{\underset{O}{\|}}{C}\underset{\underset{O}{\|}}{C}O—$ | $—NH_2 + HO—$ |

The chemical bonds shown in the Table above are connected directly or through an alkylene group and/or a phenylene group with a heterocyclic moiety constituting a development inhibitor and connected directly with Y. When the divalent linking group is connected through an alkylene group/or a phenylene group, the alkylene group and/or phenylene group may contain an ether bond, an amino bond, a carbonyl group, a thioether bond, a sulfon group, a sulfamide bond or a ureido bond.

The aliphatic group represented by Y is an aliphatic hydrocarbon group having from 1 to 10 carbon atoms, and may be saturated or unsaturated, a straight chain or branched chain, and substituted or unsubstituted. A substituted aliphatic hydrocarbon group is particularly preferred.

The alicyclic group represented by Y is an alicyclic hydrocarbon group having from 1 to 10 carbon atoms and may be saturated or unsaturated and substituted or unsubstituted. A substituted alicyclic hydrocarbon group is particularly preferred.

The aromatic group represented by Y may be a substituted or unsubstituted phenyl group or a substituted or unsubstituted naphthyl group.

The heterocyclic group represented by Y is a substituted or unsubstituted 4-membered to 8-membered heterocyclic group containing a sulfur atom, an oxygen atom or a nitrogen atom as a hetero atom.

Specific examples of the heterocyclic groups to be used include a pyridyl group, an imidazolyl group, a furyl group, a pyrazolyl group, an oxazolyl group, a thiazolyl group, a thiadiazolyl group, a triazolyl group, a diazolidinyl group, or a diazinyl group.

Examples of the substituents for the substituted aliphatic group, alicyclic group, aromatic group or heterocyclic group include a halogen atom, a nitro group, an alkoxy group having from 1 to 10 carbon atoms, an aryloxy group having from 6 to 10 carbon atoms, an alkanesulfonyl group having from 1 to 10 carbon atoms, an arylsulfonyl group having from 6 to 10 carbon atoms, an alkanamido group having from 1 to 10 carbon atoms, an anilino group, a benzamido group, a carbamoyl group, an alkylcarbamoyl group having from 1 to 10 carbon atoms, an arylcarbamoyl group having from 6 to 10 carbon atoms, an alkylsulfonamido group having from 1 to 10 carbon atom, an arylsulfonamido group having from 6 to 10 carbon atom, an alkylthio group having from 1 to 10 carbon atoms, an arylthio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having from 1 to 10 carbon atoms, an alkanoyl group having from 1 to 10 carbon atoms, a benzoyl group, an alkanoyloxy group having from 1 to 10 carbon atoms, a benzoyloxy group, a perfluoroalkyl group having from 1 to 5 carbon atoms, a cyano group, a tetrazolyl group, a hydroxy group, a mercapto group, an amino group, an alkylsulfamoyl group having from 1 to 10 carbon atoms, an arylsulfamoyl group having from 6 to 10 carbon atoms, a morpholino group, an aryl group having from 6 to 10 carbon atoms, a pyrrolidinyl group, a ureido group, a urethane group, an alkoxycarbonyl group having from 1 to 10 carbon atoms, an aryloxycarbonyl group having from 6 to 10 carbon atoms, an imidazolidinyl group, or an alkylidenamino group having from 1 to 10 carbon atoms, etc.

Specific examples of the compounds used in the present invention are set forth below, but the present invention should not be construed as being limited thereto.

(1)
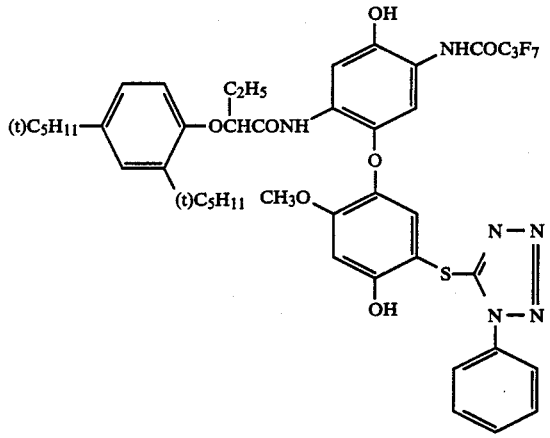
(2)
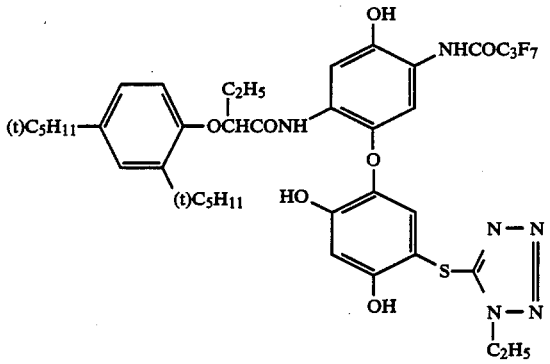
(3)
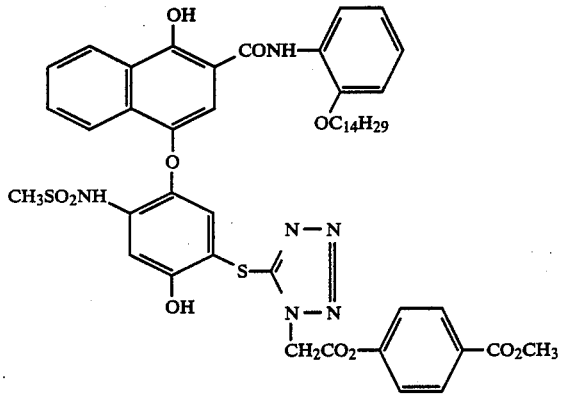
(4)
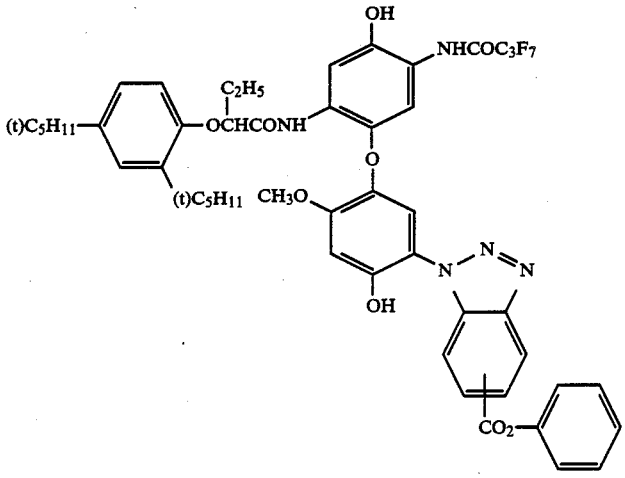

-continued
(5)
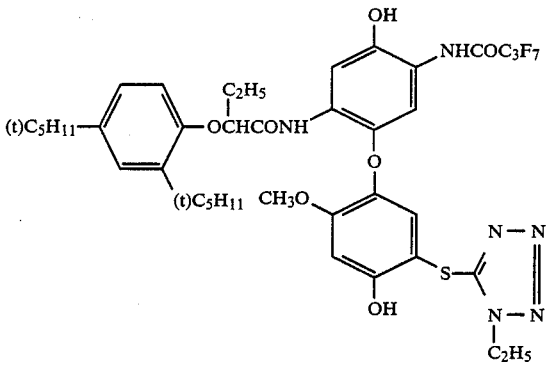
(6)
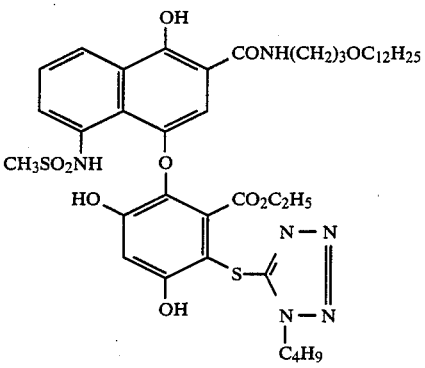
(7)
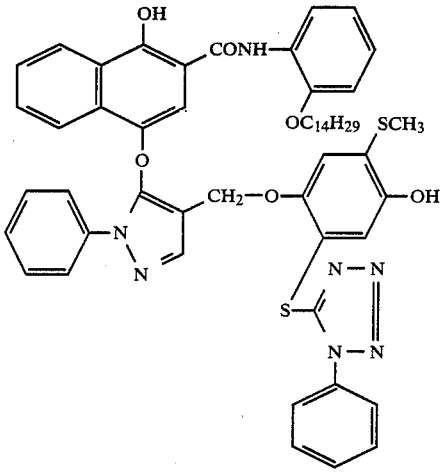
(8)
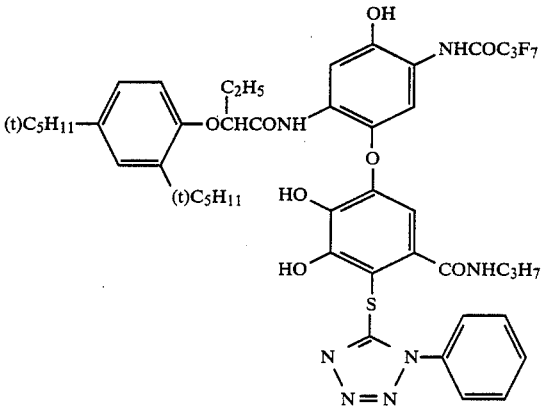

-continued
(9)
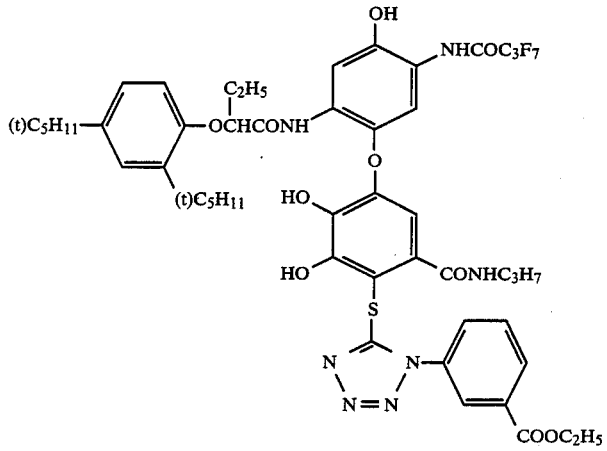
(10)
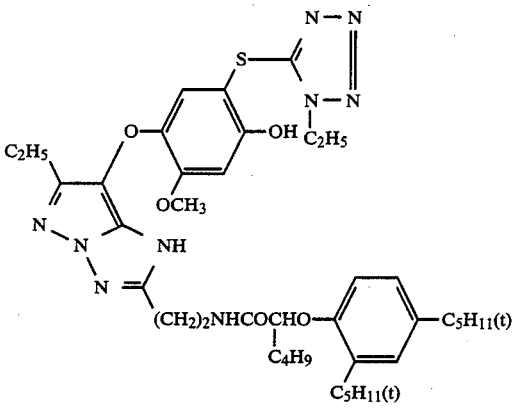
(11)
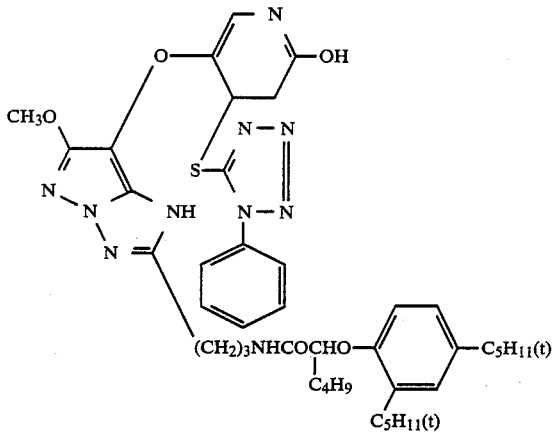
(12)
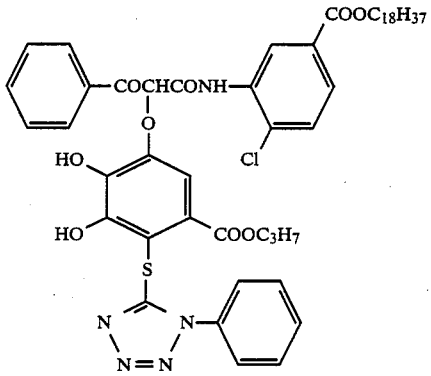

-continued
(13)
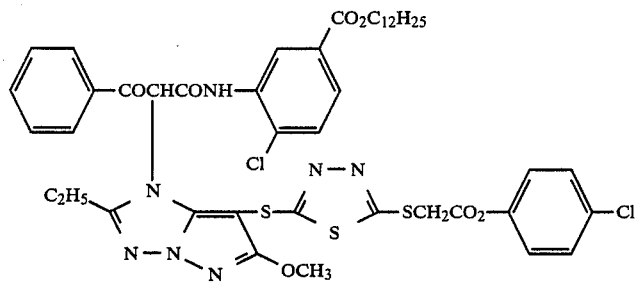
(14)
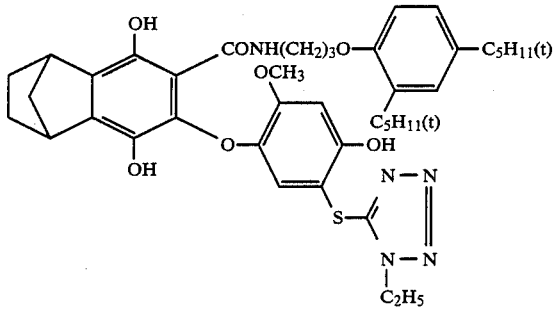
(15)
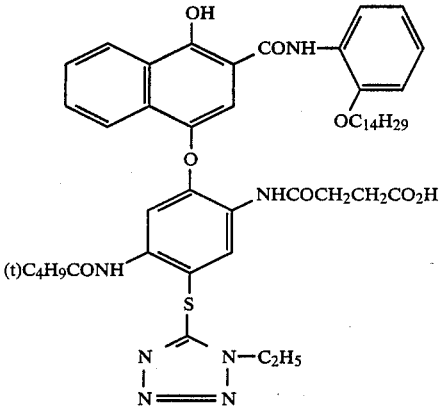
(16)
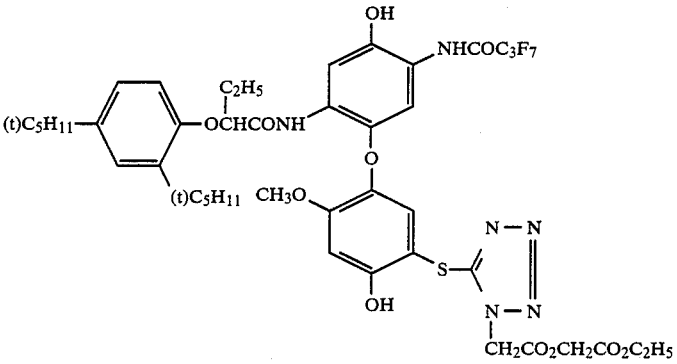

-continued (17)

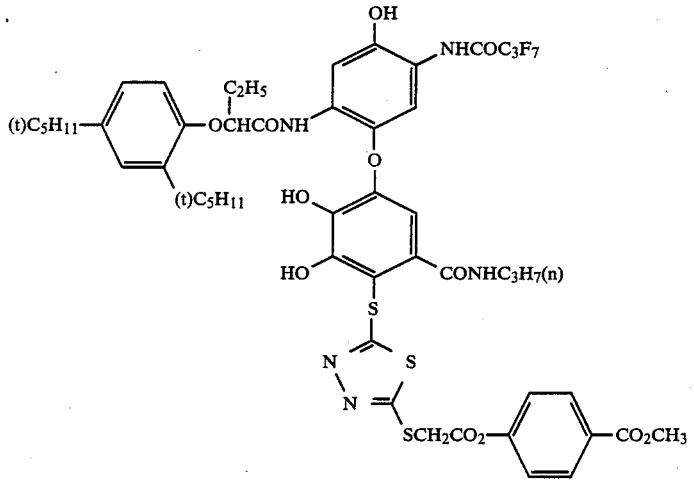

(18) to (35)

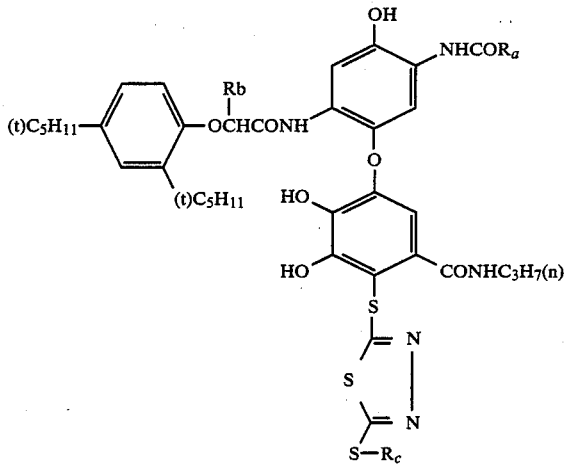

| Compound No. | Ra | Rb | Rc |
|---|---|---|---|
| (18) | $-C_3F_7(n)$ | H | $-CH_2CH_2CO_2CH_3$ |
| (19) | " | $C_2H_5$ | " |
| (20) | $-CH_3$ | H | " |
| (21) | " | $C_2H_5$ | " |
| (22) | 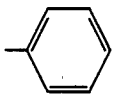 | H | " |
| (23) | " | $C_2H_5$ | " |
| (24) | $-(t)C_4H_9$ | H | |
| (25) | " | $C_2H_5$ | " |
| (26) | $-C_3F_7(n)$ | H | $-CH(CH_3)CO_2CH_3$ |
| (27) | " | $C_2H_5$ | " |
| (28) | $-CH_3$ | H | " |
| (29) | " | $C_2H_5$ | " |
| (30) | 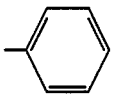 | H | " |
| (31) | " | $C_2H_5$ | " |
| (32) | $-(t)C_4H_9$ | H | " |
| (33) | " | $C_2H_5$ | " |

-continued

| Compound No. | Ra | Rb | Rc |
|---|---|---|---|
| (34) | $-C_3F_7(n)$ | H | $-CH_2CO_2CH_3$ |
| (35) | $-C_3F_7(n)$ | $(n)C_4H_9$ | " |

The compounds represented by the general formula (I) can be synthesized with reference to synthesis methods as described, for example, in Japanese patent application (OPI) Nos. 185950/85, 233741/86 and 238047/86.

Typical synthesis examples of the compounds according to the present invention are illustrated below, and other compounds can be synthesized in a similar manner. Unless otherwise stated herein, all parts, percents, ratios and the like are by weight.

SYNTHESIS EXAMPLE 1

Synthesis of Compound (1)

Compound (1) was synthesized according to the route schematically shown below.

Starting Compounds:

-continued
1 2
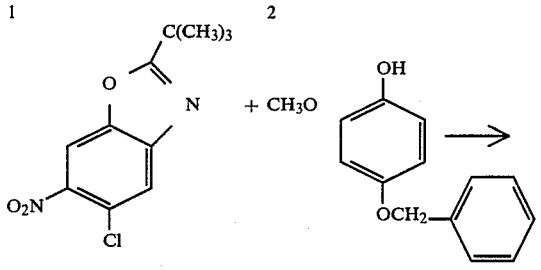
Intermediate Compounds:
3
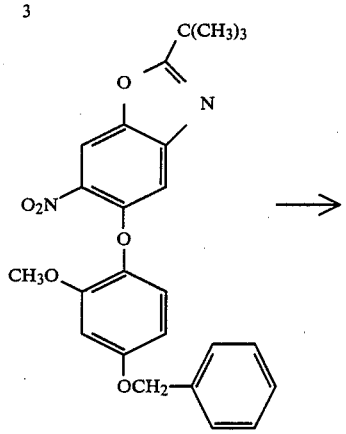
4
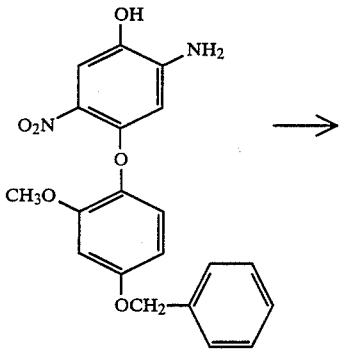
5
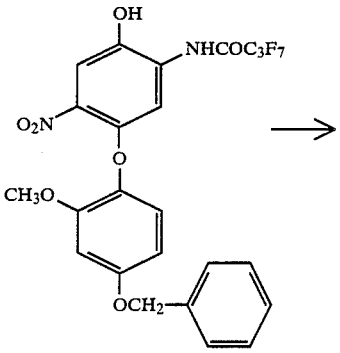
-continued
6
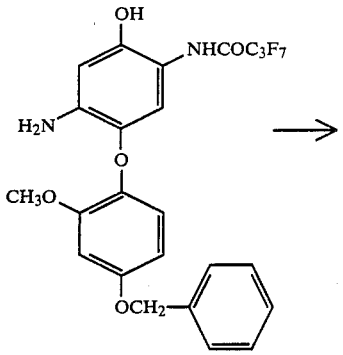
7
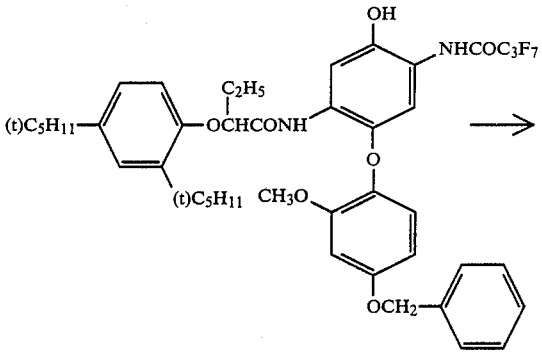
8
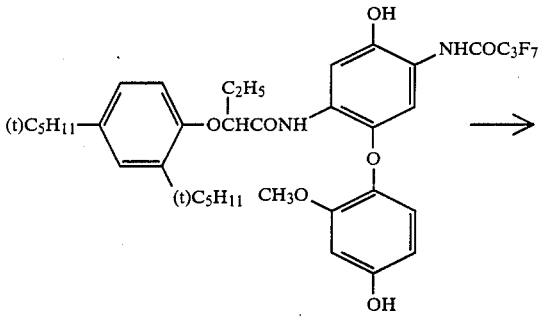
End product:
Compound (1)
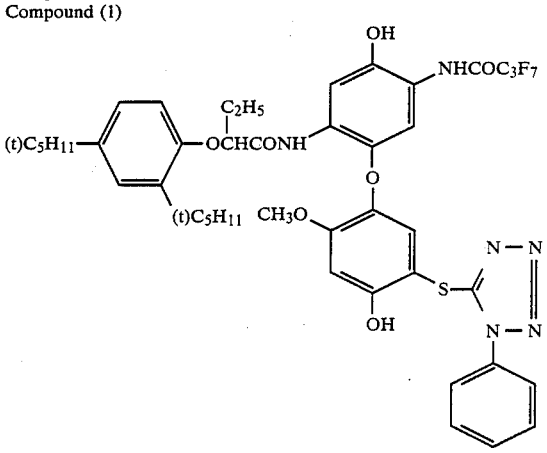

STEP (1)

Synthesis of Intermediate Compound 3

62 g of Compound 2, 18 g of potassium hydroxide and 10 ml of water were added to 700 ml of toluene and the mixture was refluxed by heating for 1 hour under nitrogen atmosphere. Then, water was distilled off together with toluene as an azeotropic mixture. To the residue was added 200 ml of N,N-dimethylformamide, the mixture was heated to 100° C. to which was added 57 g of Starting Compound 1. After being reacted at 100° C. for 1 hour, the mixture was cooled to room temperature and ethyl acetate was added thereto. The mixture was put into a separatory funnel and washed with water. The ethyl acetate layer was separated and the solvent was distilled off under a reduced pressure to obtain 53 g of the oily residue containing Intermediate Compound 3 as the main component.

STEP (2)

Synthesis of Intermediate Compound 4

53 g of Intermediate Compound 3 obtained in Step (1) was dissolved in a solvent mixture of 400 ml of ethanol and 120 ml of water and 40 g of potassium hydroxide was added thereto. After refluxing by heating for 4 hours, the mixture was neutralized with hydrochloric acid and then separately extracted using ethyl acetate and water. The ethyl acetate layer was separated and the solvent was distilled off under a reduced pressure to obtain 43 g of the oily product containing Intermediate Compound 4 as the main component.

STEP (3)

Synthesis of Intermediate Compound 5

43 g of Intermediate Compound 4 obtained in Step (2) was dissolved in 300 ml of ethyl acetate and to the solution was added dropwise 69 g of anhydrous heptafluorobutyric acid at room temperature. After being reacted for 30 minutes, water was added to the mixture and washed with water using a separatory funnel. The oil layer was separated and the solvent was distilled off. The residue was treated with column chromatography in order to separate and purify the desired compound. Silica gel was used as a packing material and chloroform containing 2.5% ethanol was used as an eluent. 47 g of Intermediate Compound 5 was obtained as the oily product.

STEP (4)

Synthesis of Intermediate Compound 6

47 g of Intermediate Compound 5 obtained in Step (3), 36.3 g of iron powder and 10 ml of acetic acid were added to a solvent mixture of 40 ml of water and 400 ml of isopropanol, and the mixture was refluxed by heating for 1 hour. The reaction mixture was filtered while it was hot and the filtrate was concentrated to about the half volume. The crystals thus-deposited were collected by filtration to obtain 44 g of Intermediate Compound 6.

STEP (5)

Synthesis of Intermediate Compound 7

44 g of Intermediate Compound 6 obtained in Step (4) was added to 400 ml of acetonitrile and refluxed by heating. 28 g of 2-(2,4-di-tert-amylphenoxy)butanoyl chloride was added dropwise thereto and the mixture was refluxed by heating for 30 minutes. Then, the mixture was cooled to room temperature, to which was added ethyl acetate and the mixture was washed with water using a separatory funnel. The oil layer was separated and the solvent was distilled off under a reduced pressure. The residue was recrystallized from acetonitrile to obtain 60 g of Intermediate Compound 7.

STEP (6)

Synthesis of Intermediate Compound 8

60 g of Intermediate Compound 7 obtained in Step (5) was added to 500 ml of dichloromethane and the mixture was cooled to —10° C. to which was added dropwise 34.5 g of boron tribromide. After being reacted at −5° C. or below for 20 minutes, an aqueous solution of sodium carbonate was added to the mixture until the aqueous layer showed neutral. The mixture was put into a separatory funnel and washed with water. The oil layer was separated and the solvent was distilled off under a reduced pressure. The residue was recrystallized from acetonitrile to obtain 45.2 g of Intermediate Compound 8.

STEP (7)

Synthesis of Compound (1)

45.2 g of Intermediate Compound 8 obtained in Step (6) was added to 600 ml of acetonitrile and to the mixture was added dropwise 100 ml of a chloroform solution containing 20.2 g of 1-phenyltetrazolyl-5-sulfenyl chloride at room temperature (25° C.). After adding ethyl acetate, the mixture was put into a separatory funnel and washed with water. The oil layer was separated and the solvent was distilled off. The residue was recrystallized from a solvent mixture of hexane and ethyl acetate to obtain 45.3 g of Compound (1).

SYNTHESIS EXAMPLE 2

Synthesis of Compound (16)

Compound (16) was synthesized in the same manner as described in Synthesis Example 1 except using 26.7 g of 1-ethoxycarbonylmethoxycarbonylmethyl-5-sulfenyl chloride in place of 20.2 g of 1-phenyltetrazolyl-5-sulfenyl chloride in Step (7) of Synthesis Example 1. Further, the solvent for recrystallization was changed to a solvent mixture of hexane and chloroform.

SYNTHESIS EXAMPLE 3

Synthesis of Compound (8)

Compound (8) was synthesized according to the route schematically shown below.

Starting Compounds:

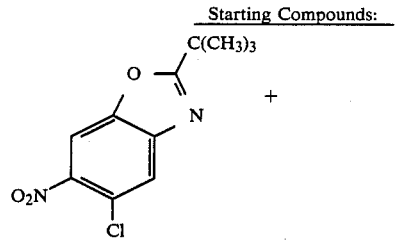

1

-continued

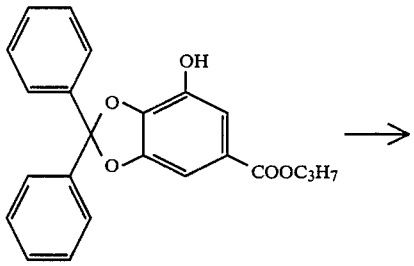

Intermediate Compounds:

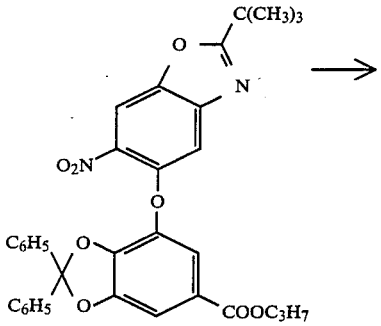

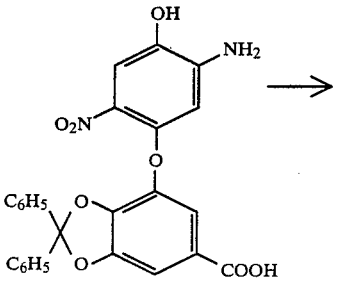

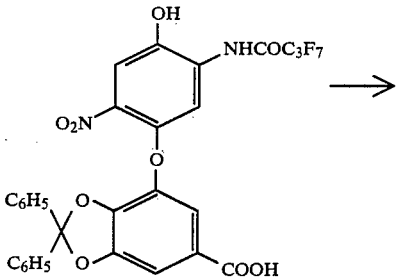

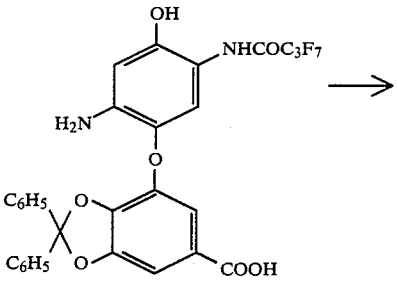

-continued

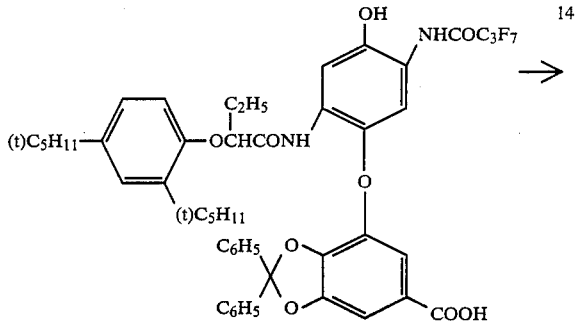

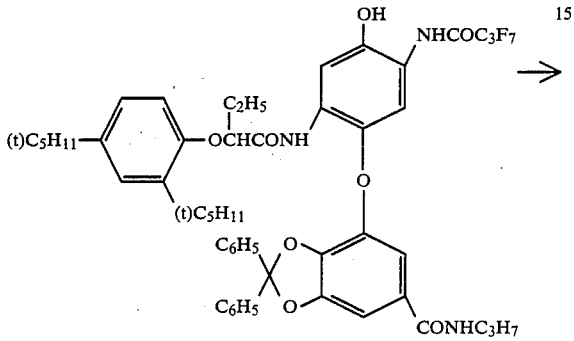

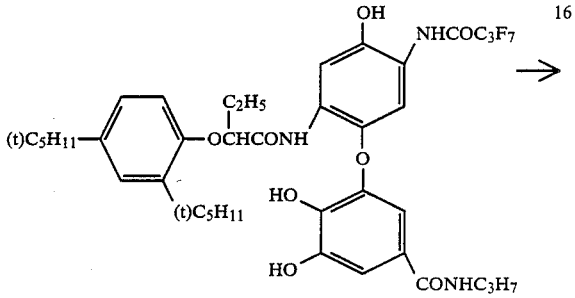

End Product:

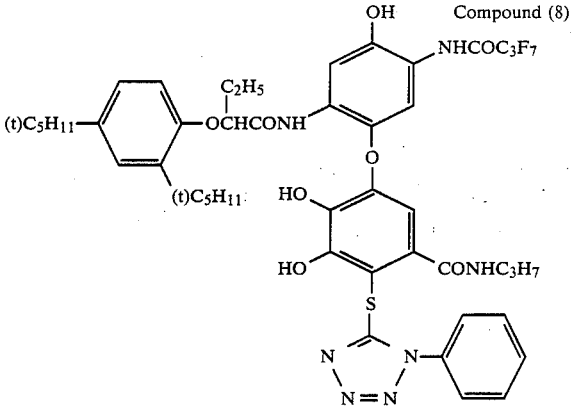

Compound (8)

STEP (1)

Synthesis of Intermediate Compound 10

147.7 g of Starting Compound 9 (synthesized according to the method as described in *J. Am. Chem. Soc.*, Vol. 81, page 4606 (1959)), 24.6 g of potassium hydroxide and 15 ml of water were added to 1 liter of toluene and the mixture was refluxed by heating for 1 hour. Water and toluene were distilled off as an azeotropic mixture. To the residue were added 500 ml of N,N-dimethylformamide, 70 g of Starting Compound 1 and 0.5 g of cuprous chloride, and the mixture was reacted at 120° C. for 4 hours. After cooling to room temperature, 12 ml of hydrochloric acid, 150 ml of water and 500 ml of methanol were added thereto. The crystals thus-deposited were collected by filtration to obtain 120 g of Intermediate Compound 10.

STEP (2)

Synthesis of Intermediate Compound 11

55.9 g of Intermediate Compound 10 obtained in Step (1) was added to a solvent mixture of 300 ml of ethanol and 100 ml of water, and the solution was bubbled with nitrogen gas. To the solution was added 31.4 g of potassium hydroxide and the mixture was refluxed by heating for 6 hours. After cooling to room temperature, the mixture was neutralized with hydrochloric acid. 500 ml of ethyl acetate was added thereto and the mixture was put into a separatory funnel and washed with water. The oil layer was separated and the solvent was distilled off under a reduced pressure to obtain 46.2 g of the residue.

STEP (3)

Synthesis of Intermediate Compound 12

46.2 g of Intermediate Compound 11 obtained in Step (2) was dissolved in 500 ml of ethyl acetate and to the solution was added dropwise 47.3 g of anhydrous heptafluorobutyric acid at room temperature. After being reacted for 40 minutes at room temperature, an aqueous solution of sodium carbonate was added thereto to neutralize. The oil layer was washed with water in a separatory funnel and separated. The solvent was distilled off under a reduced pressure and to the residue was added chloroform. The crystals thus-deposited were removed by filtration and the filtrate was concentrated to obtain 52.5 g of Intermediate Compound 12.

STEP (4)

Synthesis of Intermediate Compound 13

52.5 g of Intermediate Compound 12 obtained in Step (3), 53 g of reducing iron, 3 g of ammonium chloride and 3 ml of acetic acid were added to a solvent mixture of 280 ml of isopropanol and 40 ml of water and the mixture was refluxed by heating for 1 hour. The reaction mixture was filtered while it was hot and the filtrate was concentrated under a reduced pressure until the deposition of crystals were observed, followed by cooling. The crystals thus-deposited were collected by filtration to obtain 45.2 g of Intermediate Compound 13.

STEP (5)

Synthesis of Intermediate Compound 14

45.2 g of Intermediate Compound 13 obtained in Step (4) was added to 500 ml of acetonitrile and to the solution was added dropwise 28.3 g of 2-(2,4-di-tert-amylphenoxy)butanoyl chloride under refluxing by heating. After being reacted under refluxing for 30 minutes, the mixture was cooled to room temperature, to which was added 500 ml of ethyl acetate and washed with water. The oil layer was separated and the solvent was distilled off under a reduced pressure. The residue was recrystallized from a solvent mixture of ethyl acetate and n-hexane to obtain 56.7 g of Intermediate Compound 14.

STEP (6)

Synthesis of Intermediate Compound 15

56.7 g of Intermediate Compound 14 obtained in Step (5) was added to a solvent mixture of 250 ml of tetrahydrofuran, 250 ml of acetonitrile and 10 ml of N,N-dimethylformamide and to the solution was added dropwise 42.4 g of thionyl chloride at room temperature. After being reacted for 30 minutes, the solution was cooled to −10° C., to which was added dropwise 67.7 g of propylamine while maintaining the temperature below 0° C. After being reacted below 0° C. for 30 minutes, ethyl acetate was added to the solution and washed with water. The oil layer was separated and the solvent was distilled off under a reduced pressure. The residue was recrystallized from a solvent mixture of ethyl acetate and hexane to obtain 45.2 g of Intermediate Compound 15.

STEP (7)

Synthesis of Intermediate Compound 16

45.2 g of Intermediate Compound 15 obtained in Step (6) was added to a solvent mixture of 300 ml of methanol and 15 ml of hydrochloric acid and the mixture was refluxed by heating for 1 hour. After cooling to room temperature, 200 ml of water was added thereto and the crystals thus deposited were collected by filtration to obtain 28.6 g of Intermediate Compound 16.

STEP (8)

Synthesis of Compound (8)

28.6 g of Intermediate Compound 16 obtained in Step (7) was added to 600 ml of tetrahydrofuran, and the solution was cooled to −10° C., to which was added 4.6 g of aluminum chloride. To the solution was added dropwise 60 ml of a dichloromethane solution containing 8.8 g of 1-phenyltetrazolyl-5-sulfenyl chloride. After being reacted at −10° C. for 30 minutes, ethyl acetate and water were added to the reaction mixture. The oil layer was separated using a separatory funnel and washed with water. The solvent was distilled off under a reduced pressure, and the residue was recrystallized from a solvent mixture of hexane and ethanol to obtain 24.9 g of Compound (8).

SYNTHESIS EXAMPLE 4

Synthesis of Compound (17)

Compound (17) was synthesized in the same manner as described in Synthesis Example 3 except using 16.8 g of 5-(4-methoxycarbonylphenoxycarbonylmethylthio)-1,3,4-thiadiazolyl-2-sulfenyl chloride in place of 8.8 g of 1-phenyltetrazolyl-5-sulfenyl chloride in Step (8) of Synthesis Example 3.

SYNTHESIS EXAMPLE 5

Synthesis of Compound (18)

Compound (18) was synthesized according to the route schematically shown below.

Intermediate Compounds:

-continued

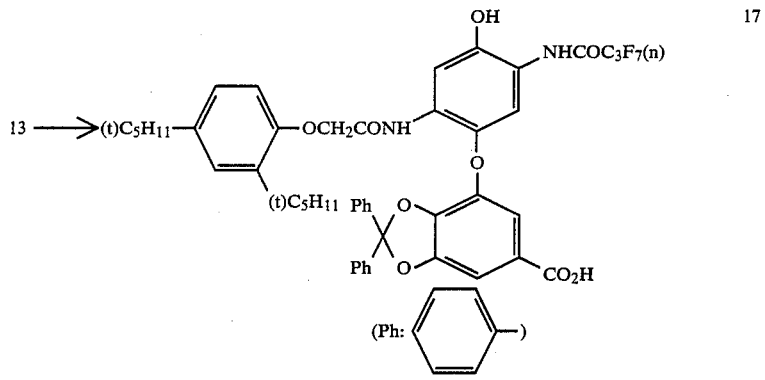

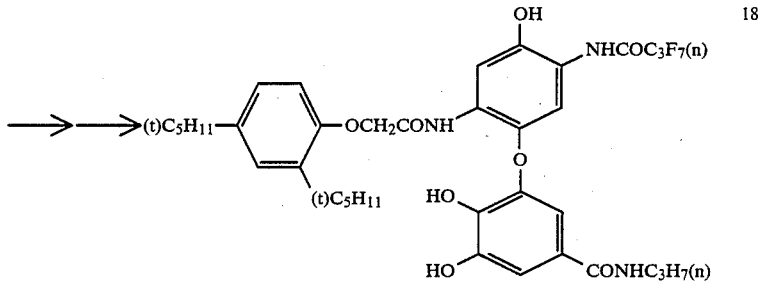

End Product:

→ Compound (18)

STEP (1)

Synthesis of Intermediate Compound 17

19.6 g of Intermediate Compound 13 from Synthesis Example 3 was suspended in a mixture composed of 15 g of iron powder, 1 g of ammonium chloride, 10 ml of water and 80 ml of isopropyl alcohol, 1 ml of acetic acid was added to the suspension and the mixture was refluxed for 20 minutes. The reaction solution was filtered to remove iron powder and the filtrate was concentrated under a reduced pressure. To the residue were added 100 ml of acetonitrile, and then dropwise 9.0 g of 2,4-di-tert-amylphenoxyacetyl chloride at 40° C. After stirring for 1 hour, the crystals thus-deposited were collected by filtration to obtain 21.2 g of Intermediate Compound 17.

STEP (2)

Synthesis of Intermediate Compound 18

21.2 g of Intermediate Compound 17 obtained in Step (1) was dissolved in 100 ml of dimethylacetamide and to the solution was added dropwise 5.4 g of thionyl chloride at 0° C. After stirring for 30 minutes, the reaction solution was cooled to −10° C., to which was added dropwise 50 ml of a dimethylacetamide solution containing 8.1 g of propylamine while maintaining the temperature below 0° C. After stirring for 2 hours, the reaction product was extracted with ethyl acetate, washed with water and the solvent was distilled off. To the crude crystals thus-obtained were added 60 ml of acetic acid and 2 ml of hydrochloric acid and the mixture was refluxed for 1 hour. After cooling, 120 ml of water was gradually added dropwise to the reaction solution. The crystals thus-deposited were collected by filtration and washed with acetonitrile to obtain 12.9 g of Intermediate Compound 18 as white crystals.

STEP (3)

Synthesis of Compound 18

12.9 g of Intermediate Compound 18 obtained in Step (2), 17.4 g of 2-(2-methoxycarbonyl)ethylthio-5-chlorothio-1,3,4-thiadiazole and 4.2 g of triphenyl phosphine were dissolved in 130 ml of tetrahydrofuran and the solution was refluxed for 2 hours. The reaction product was extracted with ethyl acetate, washed with water and the solvent was distilled off. The residue was crystallized from chloroform and hexane to obtain 10.0 g of Compound (18). Melting Point: 218.0° to 219.0° C.

SYNTHESIS EXAMPLE 6

Synthesis of Compound (19)

Compound (19) was synthesized in the same manner as described in Synthesis Example 5 except using α-(2,4-ditert-amylphenoxy)butanoyl chloride in place of 2,4-di-tertamylphenoxyacetyl chloride. Melting point: 207.0° to 212.0° C.

SYNTHESIS EXAMPLE 7

Synthesis of Compound (34)

Compound (34) was synthesized in the same manner as described in Synthesis Example 5 except using 2-methoxycarbonylthio-5-chlorothio-1,3,4-thiadiazole in place of 2-(2-methoxycarbonyl)ethylthio-5-chlorothio-1,3,4-thiadiazole. Melting Point: 208.0° to 209.0° C.

SYNTHESIS EXAMPLE 8

Synthesis of Compound (26)

Compound (26) was synthesized in the same manner as described in Synthesis Example 5 except using 2-(1-methoxycarbonylthio-1-methyl)methylthio-5-chlorothio-1,3,4-thiadiazole in place of 2-(2-methoxycarbonyl)ethylthio-5-chlorothio-1,3,4-thiadiazole. Melting Point: 136.0° to 138.0° C.

The compounds represented by general formula (I) used in the present invention are preferably incorporated into a light-sensitive silver halide emulsion layer or an adjacent layer thereto of the color light-sensitive material. The amount of the compound added is generally in a range from $1\times10-6$ to $1\times10^{-3}$ mol/m$^2$, preferably from $3\times10^{-6}$ to $5\times10^{-4}$ mol/m$^2$, and more preferably from $1\times10^{-5}$ to $2\times10^{-4}$ mol/m$^2$.

The compound represented by general formula (I) according to the present invention can be incorporated into the color light-sensitive material in a manner similar to conventional couplers as described hereinafter.

In the present invention, various color couplers can be employed and specific examples thereof are described in the patents cited in *Research Disclosure,* No. 17643, "VII-C" to "VII-G" (December, 1978).

As yellow couplers used in the present invention those as described in U.S. Pat. Nos. 3,933,501, 4,022,620, 4,326,024 and 4,401,752, Japanese Patent Publication No. 10739/83, British Pat. Nos. 1,425,020 and 1,476,760, etc., are preferred.

As magenta couplers used in the present invention, 5-pyrazolone type and pyrazoloazole type compounds are preferred. Magenta couplers as described in U.S. Pat. Nos. 4,310,619 and 4,351,897, European Pat. No. 73,636, U.S. Pat. Nos. 3,061,432 and 3,725,067, *Research Disclosure,* No. 24220 (June, 1984), Japanese patent application (OPI) No. 33552/85, *Research Disclosure,* No. 24230 (June, 1984), Japanese patent application (OPI) No. 43659/85, U.S. Pat. Nos. 4,500,630 and 4,540,654, etc., are particularly preferred.

As cyan couplers used in the present invention, naphthol type and phenol type couplers are exemplified. Cyan couplers as described in U.S. Pat. No. 4,052,212, 4,146,396, 4,228,233, 4,296,200, 2,369,929, 2,801,171, 2,772,162, 2,895,826, 3,772,002, 3,758,308, 4,334,011 and 4,327,173, West German patent application (OLS) No. 3,329,729, European Pat. No. 121,365A, U.S. Pat. Nos. 3,446,622, 4,333,999, 4,451,559 and 4,427,767, European Pat. No. 161,626A, etc., are preferred.

As colored couplers for correcting undesirable absorptions of dyes formed, those as described in *Research Disclosure,* No. 17643, "VII-G", U.S. Pat. No. 4,163,670, Japanese Patent Publication No. 39413/82, U.S. Pat. Nos. 4,004,929 and 4,138,258, British Pat. No. 1,146;,368, etc., are preferably employed.

As couplers capable of forming appropriately diffusible dyes, those as described in U.S. Pat. No. 4,366,237, British Pat. No. 2,125,570, European Pat. No. 96,570, West German patent application (OLS) No. 3,234,533, etc., are preferably employed.

Typical examples of polymerized dye forming couplers are described in U.S. Pat. Nos. 3,451,820, 4,080,211 and 4,367,282, British Pat. No. 2,102,173, etc.

Couplers capable of releasing a photographically useful residual group during the course of coupling can be also employed in the present invention. As DIR couplers capable of releasing a development inhibitor, those as described in the patents cited in *Research Disclosure,* No. 17643, "VII-F" described above, Japanese patent application (OPI) Nos. 151944/82, 154234/82 and 184248/85, U.S. Pat. No. 4,248,962, etc. are preferred.

As couplers which release imagewise a nucleating agent or a development accelerator at the time of development, those as described in British Pat. Nos. 2,097,140 and 2,131,188, Japanese patent application (OPI) Nos. 157638/84 and 170840/84, etc. are preferred.

Furthermore, competing couplers such as those described in U.S. Pat. No. 4,130,427, etc., poly-equivalent couplers such as those described in U.S. Pat. Nos. 4,283,472, 4,338,393 and 4,310,618, etc., couplers capable of releasing a dye which turns to a colored form after being released such as those described in European Pat. No. 173,302A, etc., and the like may be employed in the photographic light-sensitive material of the present invention.

The couplers which can be used in the present invention can be introduced into the photographic light-sensitive material according to various known dispersing methods.

Suitable examples of organic solvent having a high boiling point which can be employed in an oil droplet-in-water type dispersing method are described in U.S. Pat. No. 2,322,027, etc.

The processes and effects of latex dispersing methods and the specific examples of latexes for loading are described in U.S. Pat. No. 4,199,363, West German patent application (OLS) Nos. 2,541,274 and 2,541,230, etc.

Suitable supports which can be used in the present invention are described, for example, in *Research Disclosure,* No. 17643, page 28 and *RD,* No. 18716, page 647, right column to page 648, left column as mentioned above.

The color photographic light-sensitive material according to the present invention can be subjected to development processing in a conventional manner as described in *Research Disclosure,* No. 17643, pages 28 to 29 and *RD,* No. 18716, page 651, left column to right column, as mentioned above.

The color developer to be used for developing the light-sensitive material of the present invention is preferably an alkaline aqueous solution containing an aromatic primary amine color developing agent as a main ingredient. As this color developing agent, p-phenylenediamine type compounds are preferably used, though aminophenolic compounds are also useful. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, sulfates, hydrochlorides or p-toluenesulfonates thereof, etc. Two or more of these compounds may be used as the case demands.

The color developer generally contains a pH buffer agent such as an alkali metal carbonate, borate or phosphate, a development inhibitor or antifoggant such as a bromide, an iodide, a benzimidazole, a benzothiazole or a mercapto compound. If necessary, a preservative may be added to the color developer, such as hydroxylamine, diethylhydroxylamine, hydrazine sulfites, phenylsemicarbazides, triethanolamine, catecholsulfonic acids, triethylenediamine(1,4-diazabicyclo(2,2,2)octane), etc., an organic solvent such as ethylene glycol or diethylene glycol, a development accelerator such as benzyl alcohol, polyethylene glycol, a quaternary ammonium or an amine, a dye-forming coupler, a competitive coupler, a fogging agent such as sodium borohydride, an auxiliary developing agent such as 1-phenyl-3-pyrazolidone, a viscosityinceasing agent, various chelating agents represented by aminopolycarboxylic acids, aminopolyphosphonic acids, alkylphosphonic acids, and phosphonocarboxylic acids such as ethylenediaminetetraacetic acid, nitrilotriaacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(ohydroxyphenylacetic acid), and salts thereof, and the like.

In conducting reversal processing, usually black-and-white development is conducted before color development. In this black-and-white processing, developers which may be used include known black-and-white developing agents such as dihydroxybenzenes (e.g., hydroquinone), 3-pyrazolidones (e.g., 1-phenyl-3-pyrazolidone) and aminophenols (e.g., N-methyl-p-aminophenol) alone or as a combination thereof.

These color developers and black-and-white developers generally have a pH of 9 to 12. Replenishing amounts of these developers are generally up to 3 liters per $m^2$ of light-sensitive materials, though the amount will depend upon the kind of color photographic materials to be processed. The replenishing amounts may be reduced to 500 ml or less per $m^2$ of color photographic materials by decreasing the concentration of bromide ion in them. In reducing the amounts of replenishers, contact area between the developer and the air in a processing tank is preferably minimized to prevent evaporation and air oxidation of the developer. The replenishing amounts may also be reduced also by depressing accumulation of bromide ion in the developer.

Color-developed photographic emulsion layers are usually bleached. Bleaching may be conducted independently or simultaneously with fixing (bleach-fixing). In order to promote this processing step, bleach-fixing may be conducted after bleaching. Further, it is also possible to conduct the processing using two continuous bleach-fixing baths, conduct fixing before bleach-fixing, or conduct bleaching after bleach-fixing, depending upon the purpose.

Suitable bleaching agents include compounds of polyvalent metals such as iron(III), cobalt(III), chromium(IV), copper(II), etc., peracids, quinones, nitro compounds, etc. As typical bleaching agents, ferricyanides; chromates; organic complex salts of iron(III) or cabalt(III), for example, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc. or of organic acids such as citric acid, tartaric acid, malic acid, etc.; persulfates; bromic acids; permanganates; nitrobenzenes, etc. may be used. Of these, iron(III) aminopolycarboxylates including iron(III) ethylenediaminetetraacetate and persulfates are preferable in view of rapid processing and prevention of environmental pollution. Further, iron(III) aminopolycarboxylate complex salts are particularly useful in both an independent bleaching solution and a bleach-fixing solution. The bleaching or bleach-fixing solutions using these iron(III) aminopolycarboxylate complex salts usually have a pH of 5.5 to 8, but may have a lower pH for accelerating the processing.

The bleaching solution and bleach-fixing solution, and pre-baths thereof may contain, if necessary, various accelerating agents. Useful specific examples of the bleaching accelerators are described below including mercapto group- or disulfido group-containing compounds described in U.S. Pat. No. 3,893,858, West German Pat. Nos. 1,290,812, 2,059,988, Japanese patent application (OPI) Nos. 32736/78, 57831/78, 37418/78, 72623/78, 95630/78, 95631/78, 104232/78, 124424/78, 141623/78, 28426/78, *Research Disclosure* No. 17129 (July, 1978), etc.; thiazolidine derivatives described in Japanese patent application (OPI) No. 140129/75; thiourea derivatives described in Japanese Patent Publication No. 8506/70, Japanese patent application (OPI) Nos. 20832/77 and 32735/78, and U.S. Pat. No. 3,706,561; iodide salts described in West German Pat. No. 1,127,715 and Japanese patent application (OPI) No. 16235/83; polyoxyethylene compounds described in West German Pat. Nos. 966,410 and 2,748,430; polyamine compounds described in Japanese Patent Publication No. 8836/70; other compounds described in Japanese patent application (OPI) Nos. 42434/74, 59644/74, 97927/78, 35727/79, 26506/80, and 163940/83; bromide ion; and the like may be used. Of these compounds, mercapto group or disulfido group containing compounds are preferable due to their large accelerating effect, with those compounds which are described in U.S. Pat. No. 3,893,858, West German Pat. No. 1,290,812, and Japanese patent application (OPI) No. 95630/78 being particularly preferable. In addition, those compounds which are described in U.S. Pat. No. 4,552,834 are also preferable. These bleaching accelerators may also be added directly to the light-sensitive materials, if desired. These accelerators are particularly effective in the case of bleach-fixing color light-sensitive materials used for photography.

Suitable fixing agents include thiosulfates, thiocyanates, thioether compounds, thioureas, a large amount of iodides, etc., with the use of thiosulfates being popular. In particular, ammonium thiosulfate is most widely used in practice. As preservatives for the bleachfixing solution, sulfites, bisulfites, or carbonylbisulfurous acid adducts are preferable.

After the desilverization processing, the silver halide color photographic material of the present invention is generally subjected to a water-washing and/or stabilizing step. The amount of water in the water-washing step is widely variable depending upon properties of light-sensitive material (based on substances present, such as couplers), end-use of the material, temperature of washing water, number of washing tanks (number of steps), manner of replenishing countercurrent or direct flow, and other various conditions. Of these, the relation between the number of washing tanks and the amount of water in multistage countercurrent processing can be determined according to the method described in *Journal of the Society of Motion Picture and Television Engineers*, vol. 64, pp. 248–253 (May, 1955).

The multistage countercurrent processing described in the above literature enables one to markedly reduce the overall amount of washing water. However, growth of bacteria due to the prolonged residence time of water within tanks often causes adhesion of suspended matter produced by the bacteria onto light-sensitive materials. In the processing of color light-sensitive materials of the present invention, it is extremely effective for solving this problem to reduce the concentration of calcium ion and magnesium ion as described in Japanese patent application No. 131632/86. It is also possible to use isothiazolone compounds and thiabendazole described in Japanese patent application (OPI) No. 8542/82, chlorine-containing bactericides such as chlorinated sodium isocyanurate, and benzotriazoles and like bactericides described in Hiroshi Horiguchi, *Bokin-bobai-zai no Kaqaku* (*Chemistry of Antibacterial and Antifungal Agents*), Eisei Gijutsu-kai, *Biseibutsu no Mekkin, Sakkin, Bobai Gijutsu* (*Sterilizing, Bactericidal, and Antifungal Techniques*), Nippon Bokin Bobai Gakkai, *Bokin Bobai-zai Jiten* (*Dictionary of Antibacterial and Antifungal Agents*).

Washing water to be used in processing the light-sensitive materials of the present invention has a pH of 4 to 9, preferably 5 to 8. Temperature of washing water and washing time may be varied depending upon the properties and end-use of light-sensitive materials, and are generally selected within the range of 15° to 45° C. and 20 seconds to 10 minutes, preferably 25° to 40° C. and 30 seconds to 5 minutes, respectively. Further, the light-sensitive material of the present invention may be directly processed with a stabilizing solution in place of the above-described water-washing. In such stabilizing processing, any of the known techniques described in Japanese patent application (OPI) Nos. 8543/82, 14834/83, and 220345/85 may be suitably employed.

In some cases, stabilizing processing is conducted subsequent to the above-described water-washing processing. As an example thereof, there may be illustrated a stabilizing bath containing formalin and a surfactant to be used as a final bath for processing color light-sensitive materials for photography. Various known chelating agents and antifungal agents may also be added to this stabilizing bath.

An overflow solution to be produced upon replenishing the washing water and/or the stabilizing solution described above may be re-utilized in the silver removal step or other processing steps.

The silver halide color light-sensitive material of the present invention may contain a color developing agent for the purpose of simplifying and accelerating development processing. For incorporating developing agents into color light-sensitive materials, various precursors of the color developing agents are preferably used. For example, indoaniline compounds described in U.S. Pat. No. 3,342,597, Schiff base type compounds described in U.S. Pat. No. 3,342,599, *Research Disclosure,* 14850 and 15159, aldol compounds described in *Research Disclosure,* 13924, metal salt complexes described in U.S. Pat. No. 3,719,492, and urethane compounds described in Japanese patent application (OPI) No. 135628/78.

The silver halide color light-sensitive material of the present invention may contain, if necessary, various 1-phenyl-3-pyrazolidones for the purpose of accelerating color development. Typical compounds of this type are described in Japanese patent application (OPI) Nos. 64339/81, 144547/82, and 115438/83.

Various processing solutions in the present invention are used at temperatures of 10° C. to 50° C. Temperatures of 33° C. to 38° C. are standard, but higher temperatures may be employed for accelerating processing and shortening processing time, or lower temperatures may be employed to improve image quality or stability of processing solutions. In addition, processing using cobalt intensification or hydrogen peroxide intensification described in West German Pat. No. 2,226,770 or U.S. Pat. No. 3,674,499 may be conducted for saving silver of the light-sensitive materials.

Further, the silver halide photographic material of the present invention may be applied to heat developable light-sensitive materials described in U.S. Pat. No. 4,500,626, Japanese patent application (OPI) Nos. 133449/85, 218443/84, and 238056/86, and European Pat. No. 210,660A2, etc.

The present invention is described in detail with reference to the following examples, but the present invention is not to be construed as being limited thereto.

EXAMPLE 1

Sample 101

On a cellulose triacetate film support provided with a subbing layer, each layer having the composition shown below was coated to prepare a multilayer color photographic light-sensitive material which was designated Sample 101.

With respect to the compositions of the layers, the coated amounts of silver halide and colloidal silver are shown by g/m$^2$ units of silver, the coated amounts of couplers, additives and gelatin are shown by g/m$^2$ unit, and the coated amounts of sensitizing dyes are shown by mol number per mol of silver halide present in the same layer.

| | |
|---|---|
| **First Layer: Antihalation Layer** | |
| Black Colloidal Silver | 0.37 (as silver) |
| U-1 | 0.027 |
| U-2 | 0.055 |
| U-3 | 0.064 |
| HBS-3 | 0.076 |
| Gelatin | 2.81 |
| **Second Layer: Intermediate Layer** | |
| U-1 | 0.027 |
| U-2 | 0.054 |
| U-3 | 0.063 |
| HBS-3 | 0.076 |
| Gelatin | 1.52 |
| **Third Layer: First Red-Sensitive Emulsion Layer** | |
| Silver iodobromide emulsion (AgI: 10 mol %, diameter of equivalent sphere: 0.9 μm, coefficient of variation: 28.8%, diameter/thickness ratio: 5.1) | 0.43 (as silver) |
| Silver iodobromide emulsion (AgI: 4 mol %, diameter of equivalent sphere: 0.6 μm, coefficient of variation: 36.6%, diameter/thickness ratio: 3.4) | 0.11 (as silver) |
| Silver iodobromide emulsion (AgI: 2 mol %, diameter of equivalent sphere: 0.45 μm, coefficient of variation: 28%, diameter/thickness ratio: 2.7) | 0.55 (as silver) |
| Sensitizing dye I | $4.7 \times 10^{-3}$ |
| C-1 | 0.14 |
| C-2 | 0.15 |
| C-3 | 0.08 |
| C-5 | 0.08 |
| HBS-1 | 0.06 |
| HBS-2 | 0.13 |
| C-10 | 0.14 |
| Gelatin | 1.66 |
| **Fourth Layer: Second Red-Sensitive Emulsion Layer** | |
| Silver iodobromide emulsion (AgI: 3.5 mol %, diameter of equivalent sphere: 0.35 μm, coefficient of variation: 10.6%, diameter/thickness ratio: 1.0) | 0.73 (as silver) |
| Sensitizing dye I | $4.0 \times 10^{-3}$ |
| C-1 | 0.27 |
| C-2 | 0.28 |

-continued

| | |
|---|---|
| C-3 | 0.07 |
| C-4 | 0.11 |
| HBS-1 | 0.12 |
| HBS-2 | 0.24 |
| C-10 | 0.007 |
| Gelatin | 2.34 |
| Fifth Layer: Intermediate Layer | |
| Gelatin | 0.92 |
| Cpd-5 | 0.10 |
| HBS-1 | 0.053 |
| Dye I | 0.075 |
| U-4 | 0.023 |
| U-5 | 0.036 |
| HBS-4 | $7.7 \times 10^{-3}$ |
| Six Layer: First Green-Sensitive Emulsion Layer | |
| Silver iodobromide emulsion (AgI: 3.5 mol %, diameter of equivalent sphere: 0.35 μm, coefficient of variation: 10.6%, diameter/thickness ratio: 1.0) | 0.48 (as silver) |
| Sensitizing dye II | $3.6 \times 10^{-3}$ |
| Sensitizing dye III | $1.7 \times 10^{-3}$ |
| C-6 | 0.33 |
| C-7 | 0.077 |
| HS-1 | 0.29 |
| Gelatin | 1.13 |
| Seventh Layer: Second Green-Sensitive Emulsion Layer | |
| Silver iodobromide emulsion (AgI: 10 mol %, diameter of equivalent sphere: 0.9 μm, coefficient of variation: 28.8%, diameter/thickness ratio: 5.1) | 0.21 (as silver) |
| Silver iodobromide emulsion (AgI: 4 mol %, diameter of equivalent sphere: 0.6 μm, coefficient of variation: 36.6%, diameter/thickness ratio: 3.4) | 0.09 (as silver) |
| Silver iodobromide emulsion (AgI: 2 mol %, diameter of equivalent sphere: 0.45 μm, coefficient of variation: 28%, diameter/thickness ratio: 2.7) | 0.24 (as silver) |
| Sensitizing dye II | $2.2 \times 10^{-3}$ |
| Sensitizing dye III | $1.0 \times 10^{-3}$ |
| C-6 | 0.20 |
| C-8 | 0.071 |
| C-4 | 0.079 |
| C-5 | 0.038 |
| HBS-1 | 0.18 |
| Gelatin | 0.79 |
| Eighth Layer: Third Green-Sensitive Emulsion Layer | |
| Silver iodobromide emulsion (AgI: 10 mol %, diameter of equivalent sphere: 1.2 μm, coefficient of variation: 29.4%, diameter/thickness ratio: 6.3) | 0.44 (as silver) |
| Sensitizing dye II | $5.6 \times 10^{-4}$ |
| Sensitizing dye III | $2.1 \times 10^{-4}$ |
| Sensitizing dye IV | $3.6 \times 10^{-5}$ |
| C-6 | 0.036 |
| C-5 | 0.020 |
| HBS-1 | 0.032 |
| Gelatin | 0.34 |
| Ninth Layer: Yellow Filter Layer | |
| Yellow colloidal silver | 0.11 (as silver) |
| Cpd-5 | 0.28 |
| HBS-1 | 0.15 |
| Gelatin | 1.19 |
| Tenth Layer: First Blue-Sensitive Emulsion Layer | |
| Silver iodobromide emulsion (AgI: 1 mol %, diameter of equivalent sphere: 0.45 μm, coefficient of variation: 20.1%, diameter/thickness ratio: 1.8) | 0.33 (as silver) |
| Sensitizing dye V | $1.7 \times 10^{-3}$ |
| C-9 | 0.65 |
| C-4 | 0.10 |
| HBS-1 | 0.22 |
| Gelatin | 0.85 |

-continued

| | |
|---|---|
| Eleventh Layer: Second Blue-Sensitive Emulsion Layer | |
| Silver iodobromide emulsion (AgI: 4.1 mol %, diameter of equivalent sphere: 0.43 μm, coefficient of variation: 25%, diameter/thickness ratio: 3.6) | 0.17 (as silver) |
| Silver iodobromide emulsion (AgI: 7 mol %, diameter of equivalent sphere: 0.9 μm, coefficient of variation: 49%, diameter/thickness ratio: 4.6) | 0.21 (as silver) |
| Sensitizing dye V | $3.0 \times 10^{-3}$ |
| C-9 | 0.28 |
| C-4 | 0.044 |
| HBS-1 | 0.10 |
| Gelatin | 0.75 |
| Twelfth Layer: First Protective Layer | |
| Gelatin | 0.60 |
| U-4 | 0.10 |
| U-5 | 0.15 |
| HBS-4 | 0.033 |
| Dye II | 0.15 |
| Thirteenth Layer: Second Protective Layer | |
| Polymethyl methacrylate particle (diameter: about 1.5 μm) | 0.14 |
| Gelatin | 0.87 |

To each layer described above were added Gelatin hardener H-1 and a surface active agent in addition to the above described components.

Sample 102

Sample 102 was prepared in the same manner as described for Sample 101, except that C-11 was added in an amount so as to provide an equal interimage effect from the blue-sensitive layer to the green-sensitive layer in place of the coupler C-4 and the gradation was adjusted in the tenth layer of Sample 101.

Samples 103 and 104

Samples 103 and 104 were prepared in the same manner as described in Samples 101 and 102, except that a silver iodobromide emulsion having AgI: 1 mol %, diameter of equivalent sphere: 0.35 μm, coefficient of variation 19.5%, diameter/thickness ratio: 1.0 was used in place of the silver iodobromide emulsion, the amount of the sensitizing dye was changed to the optimum amount and the gradation was adjusted to the tenth layer of Samples 101 and 102, respectively.

Samples 105 and 106

Samples 105 and 106 were prepared in the same manner as described in Samples 101 and 102, except that a silver iodobromide emulsion having AgI: 1 mol %, diameter of equivalent sphere: 0.31 μm, coefficient of variation 24.8%, diameter/thickness ratio: 1.0 was used in place of the silver iodobromide emulsion, the amount of the sensitizing dye was changed to the optimum amount and the gradation was adjusted in the tenth layer of Samples 101 and 102, respectively.

Samples 107 and 108

Samples 107 and 108 were prepared in the same manner as described in Samples 101 and 102, except that a silver iodobromide emulsion having AgI: 1 mol %, diameter of equivalent sphere: 0.19 μm, coefficient of variation 15.2%, diameter/thickness ratio: 1.0 was used in place of the silver iodobromide emulsion, the amount of the sensitizing dye was changed to the optimum amount and the gradation was adjusted in the tenth layer of Samples 101 and 102, respectively.

Samples 101 to 108 thus-prepared were subjected to imagewise exposure to white light and then development processing in the manner described below to obtain characteristic curves of cyan, magenta and yellow color images.

Along the characteristic curve of yellow color image, a straight line was drawn so that the main gradation portion thereof indicated the smallest value by the method of least squares. Then, two parallel lines were drawn above and below this straight line at intervals of 0.1 of density, respectively. The points at which the characteristic curve deviated from the area formed by these two lines was determined and a difference of exposure amount ($\Delta$logE) between the point of high exposure amount side and the point of low exposure amount side was obtained, which was designated an exposure latitude $L_B$.

The main gradation portion of the characteristic curve means a portion of the characteristic curve between a point having a density of 0.2 above $D_{min}$ ($S_{0.2}$) and a point having a density of 1.0 above $D_{min}$ ($S_{1.0}$).

Further, Samples 101 to 108 were subjected to uniform exposure to green light, then imagewise exposure to blue light, and thereafter development processing in the manner described below. As the result, the characteristic curve (Curve 1) of yellow color image and a curve (Curve 2) of magenta color image density were obtained as shown in FIG. 1. In FIG. 1, $\Delta D_G$ indicates a degree of inhibition in the uniformly fogged green-sensitive emulsion layer, when the blue-sensitive emulsion layer was developed between the unexposed area (Point A) and the exposed area (Point B). Specifically, in FIG. 1, Curve 1 denotes the characteristic curve of a yellow color image formed in the blue-sensitive emulsion layer and Curve 2 denotes a magenta image density curve formed in the green-sensitive layer by the uniform exposure to green light. Further, Point A denotes a fog area of the yellow image and Point B denotes an exposure area providing a yellow density of 2.5.

The difference (a−b) between a magenta density (a) at the unexposed area (Point A) and a magenta density (b) at the exposed area (Point B) was designated as $\Delta D_G$ and employed to evaluate color reproducibility (color turbidity).

The measurement of MTF value was conducted according to the method as described in Mees, *The Theory of Photographic Process*, Third Edition, The Macmillan Company.

The results thus-obtained are shown in Table 1 below.

The color development processing was carried out according to the processing steps set forth below at the processing temperature of 38° C.

| Processing Step | Time |
|---|---|
| Color Development | 3 min. 15 sec. |
| Bleaching | 6 min. 30 sec. |
| Washing with Water | 2 min. 10 sec. |
| Fixing | 4 min. 20 sec. |
| Washing with Water | 3 min. 15 sec. |
| Stabilizing | 1 min. 05 sec. |

The composition of the processing solution used in each step is illustrated below.

| | |
|---|---|
| **Color Developing Solution:** | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |
| **Bleaching Solution:** | |
| Iron (III) ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| **Fixing Solution:** | |
| Disodium ethylenediaminetetraacetate | 1.0 g |
| Sodium sulfite | 4.0 g |
| Ammonium thiosulfate (70% aq. soln.) | 175.0 ml |
| Sodium bisulfite | 4.6 g |
| Water to make | 1.0 liter |
| pH | 6.6 |
| **Stabilizing Solution:** | |
| Formalin (40%) | 2.0 ml |
| Polyoxyethylene-p-monononylphenylether (average degree of polymerization: 10) | 0.3 g |
| Water to make | 1.0 liter |

The chemical structures or chemical names of the compounds employed in Example 1 are shown below.

Sensitizing Dye

I

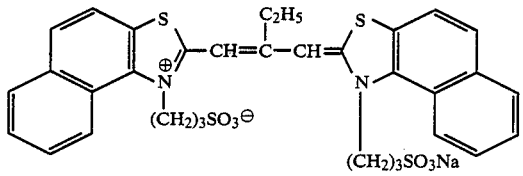

II

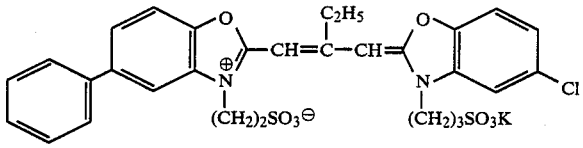

-continued
Sensitizing Dye
III
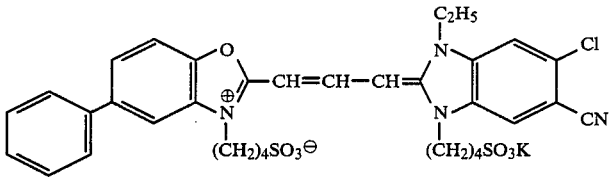
IV
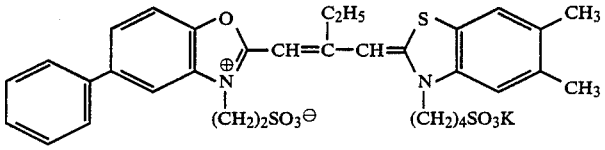
V
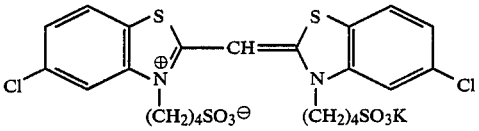
U-1
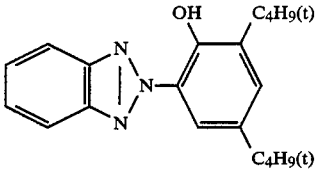
U-2
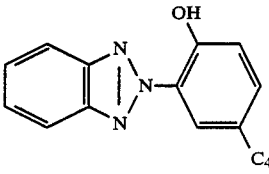
U-3
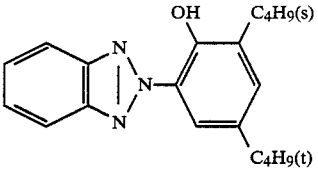
U-4
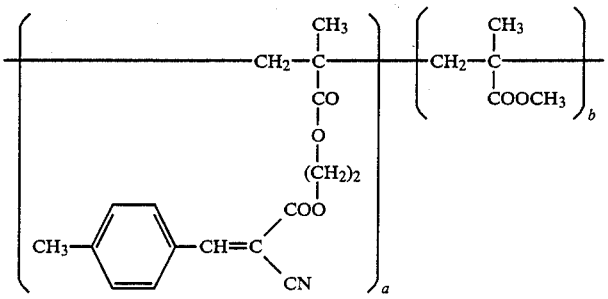
a/b = 0.7/0.3 (by weight)
U-5
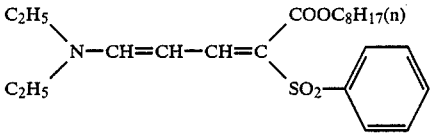

-continued
Sensitizing Dye
Dye I
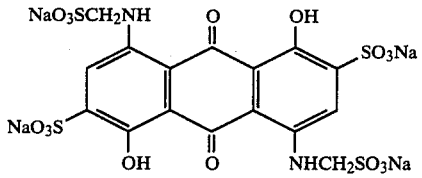
Dye II
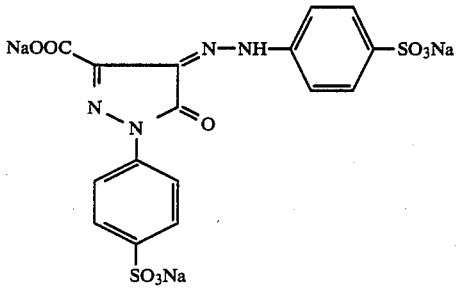
C-1
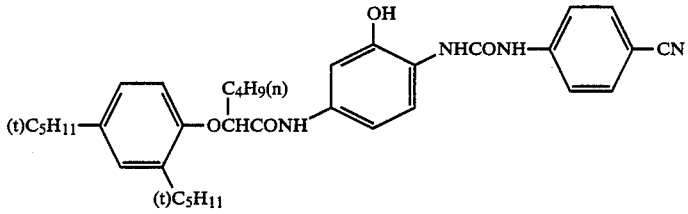
C-2
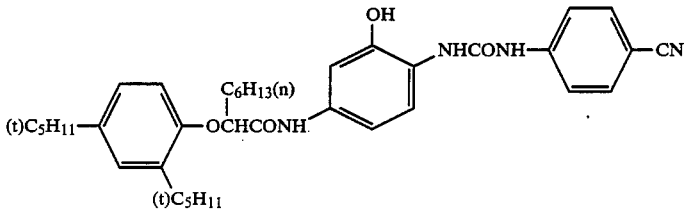
C-3
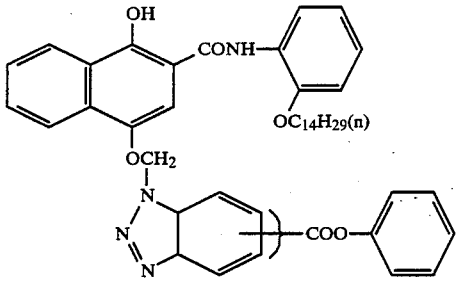
C-4
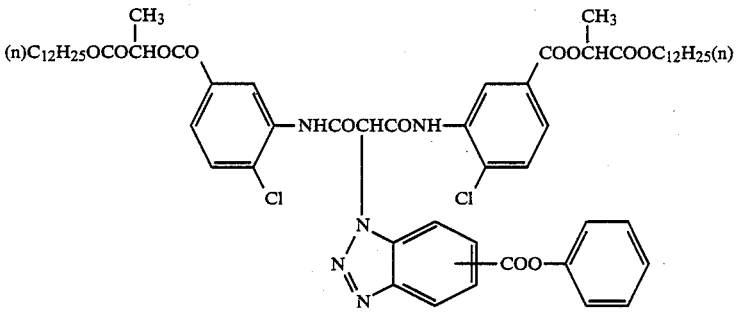

-continued
Sensitizing Dye
C-5
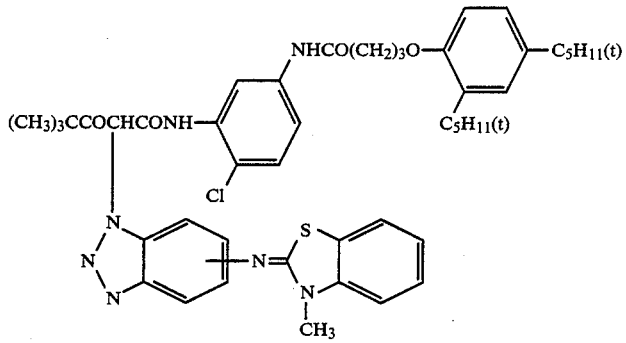
C-6
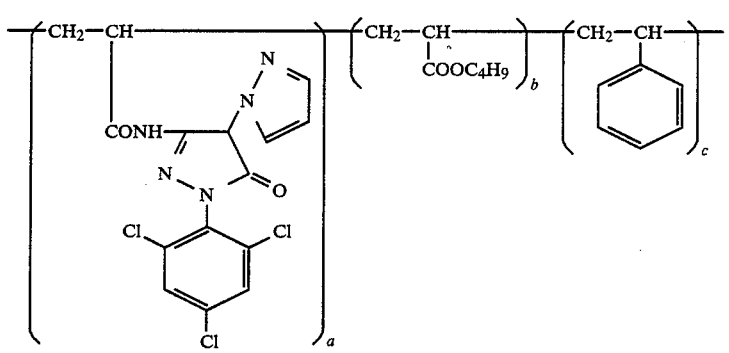
Average molecular weight: 30,000
a/b/c = 50/25/25 (by weight)
C-7
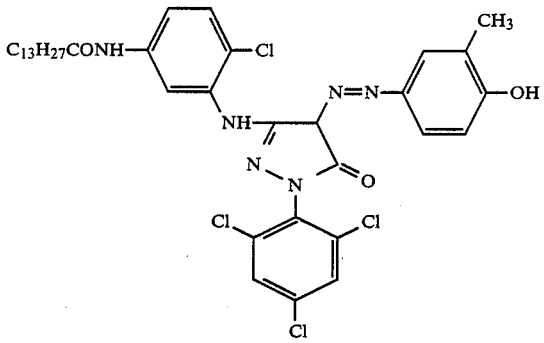
C-8
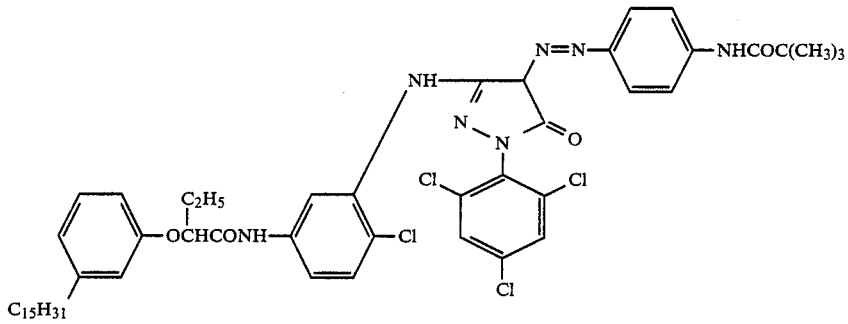

-continued
Sensitizing Dye
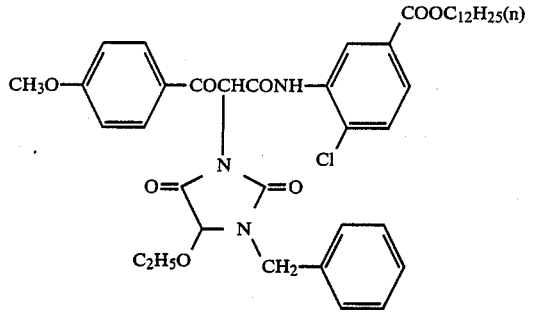
C-9
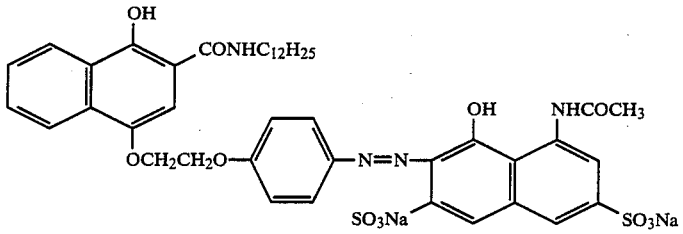
C-10
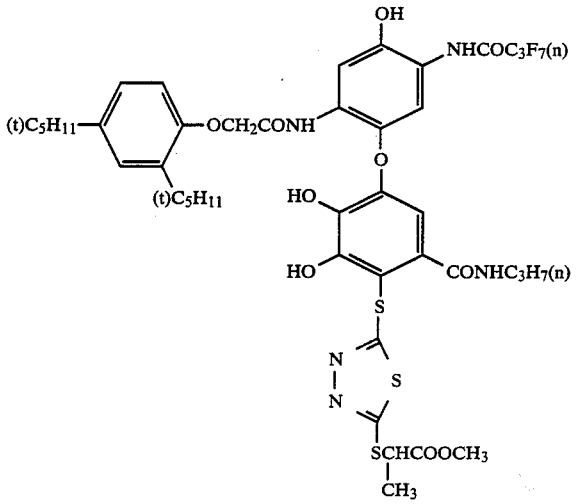
C-11 (Compound (26))
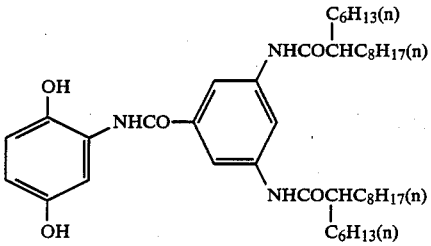
Cpd-5
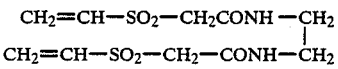
H-1
| | |
|---|---|
| Tricresyl phosphate | HBS-1 |
| Dioctyl phthalate | HBS-2 |
| Dibutyl phthalate | HBS-3 |
| Bis(2-ethylhexyl) phthalate | HBS-4 |

TABLE 1

| Sample | Particle Size[1] of Emulsion in Tenth Layer | Compound[2] Used in Tenth Layer | $\Delta D_G$ | MTF Value of Magenta Image (40 cycles/mm) | Exposure Latitude of Blue-Sensitive Layer ($L_B$) |
|---|---|---|---|---|---|
| 101 (Comparison) | 0.36 μm | C-4 | 0.29 | 0.50 | 2.3 |
| 103 (Comparison) | 0.28 μm | " | 0.22 | 0.53 | 2.8 |
| 105 (Comparison) | 0.22 μm | " | 0.17 | 0.54 | 3.2 |
| 107 (Comparison) | 0.16 μm | " | 0.14 | 0.54 | 3.7 |
| 102 (Comparison) | 0.36 μm | C-11 | 0.29 | 0.53 | 2.3 |
| 104 (Present Invention) | 0.28 μm | " | 0.28 | 0.60 | 2.8 |
| 106 (Present Invention) | 0.22 μm | " | 0.27 | 0.62 | 3.2 |
| 108 (Present Invention) | 0.16 μm | " | 0.27 | 0.63 | 3.7 |

[1]Maximum Particle size of silver halide grains taking 30% by number of whole silver halide grains counted from the smallest.
[2]Compound for improving interimage effect.

From the results shown in Table 1, it can be seen that Samples 104, 106 and 108 according to the present invention are excellent in MTF value (sharpness) of magenta image and $\Delta D_G$ (color turbidity) as compared with the samples (Samples 101, 103, 105 and 107) using the compound out of the scope of the present invention. Further, they have expanded exposure latitude, improved MTF value (sharpness) of magenta image and hardly degraded $\Delta D_G$ (color turbidity) in comparison with Sample 102.

EXAMPLE 2

In the case of using Compounds (18), (19), (27), (34) and (35 according to the present invention in place of C-11 [Compound (26) according to the present invention] added to the tenth layer of Samples 102, 104, 106 and 108 in Example 1, respectively, equivalent results to Example 1 are obtained.

EXAMPLE 3

Sample 201

On a cellulose triacetate film support provided with a subbing layer, each layer having the composition shown below was coated to prepare a multilayer color photographic light-sensitive material which was designated Sample 201.

With respect to the compositions of the layers, the coated amounts of silver halide and colloidal silver are shown by g/m$^2$ units of silver, the coated amounts of couplers, additives and gelatin are shown by g/m$^2$ unit, and the coated amounts of sensitizing dyes are shown by mol number per mol of silver halide present in the same layer.

| | |
|---|---|
| **First Layer: Antihalation Layer** | |
| Black Colloidal Silver | 0.2 |
| Gelatin | 1.3 |
| C-13 | 0.06 |
| U-4 | 0.1 |
| U-5 | 0.2 |
| HBS-1 | 0.01 |
| HBS-3 | 0.01 |
| **Second Layer: Intermediate Layer** | |
| Gelatin | 1.5 |

-continued

| | |
|---|---|
| U-4 | 0.06 |
| U-5 | 0.03 |
| C-10 | 0.02 |
| Dye III | 0.004 |
| HBS-1 | 0.1 |
| HBS-3 | 0.09 |
| **Third Layer: First Red-Sensitive Emulsion Layer** | |
| Silver iodobromide emulsion (AgI: 2 mol %, internal high AgI type, diameter of equivalent sphere: 0.38 μm, coefficient of variation of diameter of equivalent sphere: 20%, unfixed form grain, diameter/thickness ratio: 2.5) | 0.4 (as silver) |
| Gelatin | 0.6 |
| Sensitizing dye VI | $1.0 \times 10^{-4}$ |
| Sensitizing dye VII | $3.0 \times 10^{-4}$ |
| Sensitizing dye I | $1 \times 10^{-5}$ |
| C-1 | 0.06 |
| C-2 | 0.06 |
| C-12 | 0.04 |
| C-10 | 0.03 |
| HBS-1 | 0.03 |
| HBS-3 | 0 012 |
| **Fourth Layer: Second Red-Sensitive Emulsion Layer** | |
| Silver iodobromide emulsion (AgI: 5 mol %, internal high AgI type, diameter of equivalent sphere: 0.7 μm, coefficient of variation of diameter of equivalent sphere: 25%, unfixed form grain, diameter/thickness ratio: 4) | 0.7 (as silver) |
| Gelatin | 2.5 |
| Sensitizing dye VI | $1 \times 10^{-4}$ |
| Sensitizing dye VII | $3 \times 10^{-4}$ |
| Sensitizing dye I | $1 \times 10^{-5}$ |
| C-1 | 0.24 |
| C-2 | 0.24 |
| C-12 | 0.04 |
| C-10 | 0.04 |
| HBS-1 | 0.15 |
| HBS-3 | 0.02 |
| **Fifth Layer: Third Red-Sensitive Emulsion Layer** | |
| Silver iodobromide emulsion (AgI: 10 mol %, internal high AgI type, diameter of equivalent sphere: 0.8 μm, coefficient of variation of diameter of equivalent sphere: 16%, unfixed form grain, diameter/thickness ratio: 1.3) | 1.0 (as silver) |
| Gelatin | 1.0 |
| Sensitizing dye VI | $1 \times 10^{-4}$ |
| Sensitizing dye VII | $3 \times 10^{-4}$ |
| Sensitizing dye I | $1 \times 10^{-5}$ |

-continued

| | |
|---|---|
| C-14 | 0.05 |
| C-15 | 0.1 |
| HBS-1 | 0.01 |
| HBS-3 | 0.05 |
| Sixth Layer: Intermediate Layer | |
| Gelatin | 1.0 |
| Cpd-1 | 0.03 |
| HBS-1 | 0.05 |
| Seventh Layer: First Green-Sensitive Emulsion Layer | |
| Silver iodobromide emulsion (AgI: 2 mol %, internal high AgI type, diameter of equivalent sphere: 0.5 μm, coefficient of variation of diameter of equivalent sphere: 20%, unfixed form grain, diameter/thickness ratio: 2.0) | 0.30 (as silver) |
| Sensitizing dye II | $5 \times 10^{-4}$ |
| Sensitizing dye IV | $0.3 \times 10^{-4}$ |
| Sensitizing dye III | $2 \times 10^{-4}$ |
| Gelatin | 1.0 |
| C-6 | 0.2 |
| C-4 | 0.03 |
| C-13 | 0.03 |
| HBS-1 | 0.5 |
| Eighth Layer: Second Green-Sensitive Emulsion Layer | |
| Silver iodobromide emulsion (AgI: 4 mol %, internal high AgI type, diameter of equivalent sphere: 0.6 μm, coefficient of variation of diameter of equivalent sphere: 38%, unfixed form grain, diameter/thickness ratio: 4) | 0.4 (as silver) |
| Gelatin | 0.8 |
| Sensitizing dye II | $5 \times 10^{-4}$ |
| Sensitizing dye III | $2 \times 10^{-4}$ |
| Sensitizing dye IV | $0.3 \times 0\ 10^{-4}$ |
| C-6 | 0.25 |
| C-13 | 0.03 |
| C-7 | 0.015 |
| C-4 | 0.01 |
| HBS-1 | 0.2 |
| Ninth Layer: Third Green-Sensitive Emulsion Layer | |
| Silver iodobromide emulsion (AgI: 6 mol %, internal high AgI type, diameter of equivalent sphere: 1.0 μm, coefficient of variation of diameter of equivalent sphere: 80%, unfixed form grain, diameter/thickness ratio: 1.2) | 0.85 (as silver) |
| Gelatin | 1.0 |
| Sensitizing dye VIII | $3.5 \times 10^{-4}$ |
| Sensitizing dye IX | $1.4 \times 10^{-4}$ |
| C-16 | 0.01 |
| C-17 | 0.03 |
| C-18 | 0.20 |
| C-13 | 0.02 |
| C-5 | 0.02 |
| HBS-1 | 0.20 |
| HBS-3 | 0.05 |
| Tenth Layer: Yellow Filter Layer | |
| Gelatin | 1.2 |
| Yellow colloidal silver | 0.08 |
| Cpd-2 | 0.1 |
| HBS-1 | 0.3 |
| Eleventh Layer: First Blue-Sensitive Emulsion Layer | |
| iodobromide emulsion (AgI: 4 mol %, internal high AgI type, diameter of equivalent sphere: 0.5 μm, coeffcient of variation of diameter of equivalent sphere: 15%, unfixed form grain, diameter/thickness ratio: 1.0) | 0.4 (as silver) |
| Gelatin | 1.0 |
| Sensitizing dye V | $2 \times 10^{-4}$ |
| C-9 | 0.9 |
| C-4 | 0.07 |
| HBS-1 | 0.2 |
| Twelfth Layer: Second Blue-Sensitive Emulsion Layer | |
| Silver iodobromide emulsion (AgI: 10 mol %, internal high AgI type, diameter of equivalent sphere: 1.3 μm, coefficient of variation of diameter of equivalent sphere: 25%, unfixed form grain, diameter/thickness ratio: 4.5) | 0.50 (as silver) |

-continued

| | |
|---|---|
| Gelatin | 0.6 |
| Sensitizing dye V | $1 \times 10^{-4}$ |
| C-9 | 0.25 |
| HBS-1 | 0.07 |
| Thirteenth Layer: First Protective Layer | |
| Gelatin | 0.8 |
| U-4 | 0.1 |
| U-5 | 0.2 |
| HBS-1 | 0.01 |
| HBS-3 | 0.01 |
| Fourteenth Layer: Second Protective Layer | |
| Gelatin | 0.45 |
| Polymethyl methacrylate particle (diameter: 1.5 μm) | 0.2 |
| H-1 | 0.4 |
| Cpd-3 | 0.5 |
| Cpd-4 | 0.5 |

To each layer described above was added a surface active agent as a coating aid in addition to the above described components.

Sample 202

Sample 202 was prepared in the same manner as described in Sample 201, except that C-11 was added in an amount so as to provide an equal interimage effect from the red-sensitive layer to the blue-sensitive layer in place of the coupler C-12 and the gradation was adjusted in the third layer of Sample 201.

Samples 203 and 204

Samples 203 and 204 were prepared in the same manner as described in Samples 201 and 202, except that a silver iodobromide emulsion having diameter of equivalent sphere: 0.43 μm, coefficient of variation 33%, diameter/thickness ratio: 2.1 was used in place of the silver iodobromide emulsion, the amount of the sensitizing dye was changed to the optimum amount and the gradation was adjusted in the seventh layer of Samples 201 and 202, respectively.

Samples 205 and 206

Samples 205 and 206 were prepared in the same manner as described in Samples 201 and 202, except that a silver iodobromide emulsion having diameter of equivalent sphere: 0.3 μm, coefficient of variation 28%, diameter/thickness ratio: 2.5 was used in place of the silver iodobromide emulsion, the amount of the sensitizing dye was changed to the optimum amount and the gradation was adjusted in the seventh layer of Samples 201 and 202, respectively.

Samples 207 and 208

Samples 207 and 208 were prepared in the same manner as described in Samples 201 and 202, except that a silver iodobromide emulsion having diameter of equivalent sphere: 0.25 μm, coefficient of variation 32%, diameter/thickness ratio: 1.9 was used in place of the silver iodobromide emulsion, the amount of the sensitizing dye was changed to the optimum amount and the gradation was adjusted in the seventh layer of Samples 201 and 202, respectively.

Samples 201 to 208 thus-prepared were subjected to imagewise exposure to white light and then development processing in the manner described below to obtain characteristic curves of cyan, magenta and yellow color images.

Along the characteristic curve of magenta color image, a straight line was drawn so that the main gradation portion thereof indicated the smallest value by the method of least squares. Then, two parallel lines were drawn above and below this straight line at intervals of 0.1 of density, respectively. The points at which the characteristic curve deviated from the area formed by these two lines was determined and a difference of exposure amount (ΔlogE) between the point of high exposure amount side and the point of low exposure amount side was obtained, which was designated an exposure latitude $L_G$.

The main gradation portion of the characteristic curve means a portion of the characteristic curve between a point having a density of 0.2 above $D_{min}$ ($S_{0.2}$) and a point having a density of 1.0 above $D_{min}$ ($S_{1.0}$).

Figure 2:
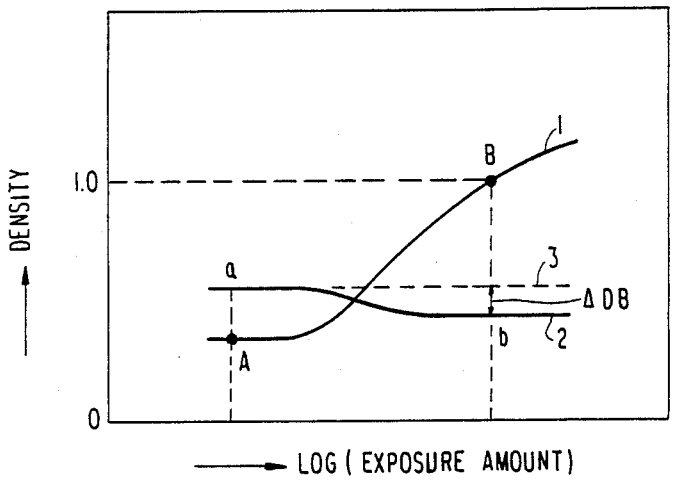

Further, Samples 201 to 208 were subjected to uniform exposure to blue light, then imagewise exposure to red light, and thereafter development processing in the manner described below. As the result, the characteristic curve (Curve 1) of cyan color image and a curve (Curve 2) of yellow color image density were obtained as shown in FIG. 2. In FIG. 2, $\Delta D_B$ indicates a degree of inhibition in the uniformly fogged blue-sensitive emulsion layer, when the redsensitive emulsion layer was developed between the unexposed area (Point A) and the exposed area (Point B). Specifically, in FIG. 2, Curve 1 denotes the characteristic curve of a cyan color image formed in the red-sensitive emulsion layer and Curve 2 denotes a yellow image density curve formed in the blue-sensitive layer by the uniform exposure to blue light. Further, Point A denotes a fog area of the cyan image and Point B denotes an exposure area providing a cyan density of 1.0.

The different (a−b) between a yellow density (a) at the unexposed area (Point A) and a yellow density (b) at the exposed area (Point B) was designated as $\Delta D_B$ and employed to evaluate color reproducibility (color turbidity).

The measurement of MTF value and the color development processing were conducted in the same manner as described in Example 1.

The results thus-obtained are shown in Table 2 below.

With respect to the compounds used in Example 2 other than those employed in Example 1, the chemical structures are shown below.

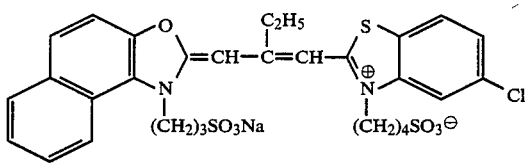

Sensitizing Dye VI

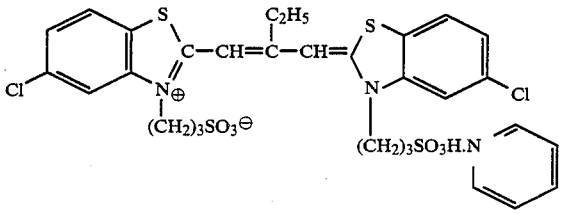

Sensitizing Dye VII

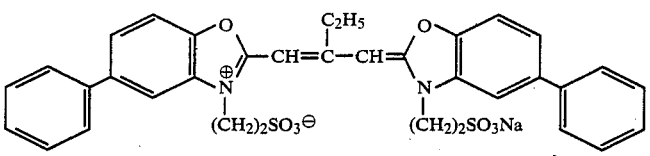

Sensitizing Dye VIII

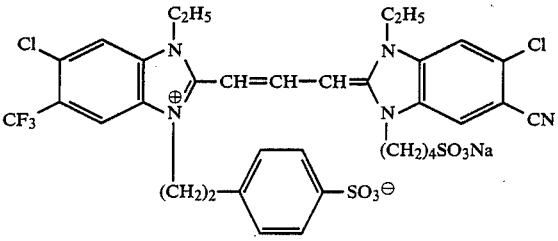

Sensitizing Dye IX

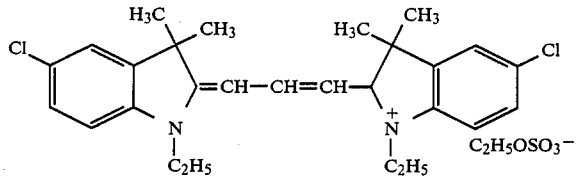

Dye III

-continued
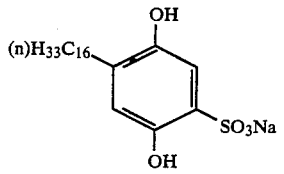
Cpd-1
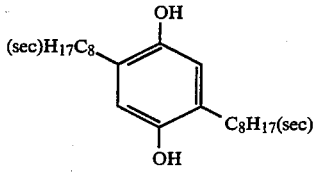
Cpd-2
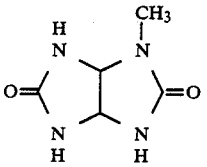
Cpd-3
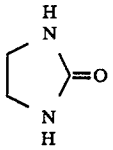
Cpd-4
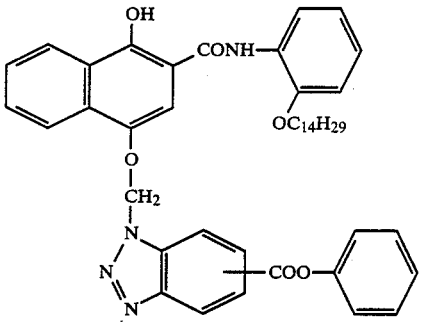
C-12
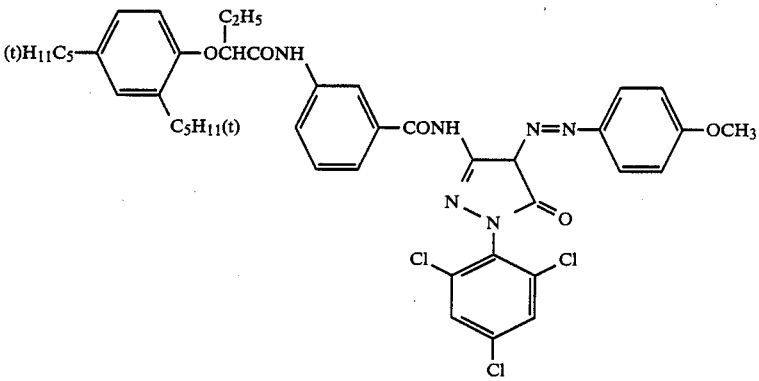
C-13

-continued
C-14
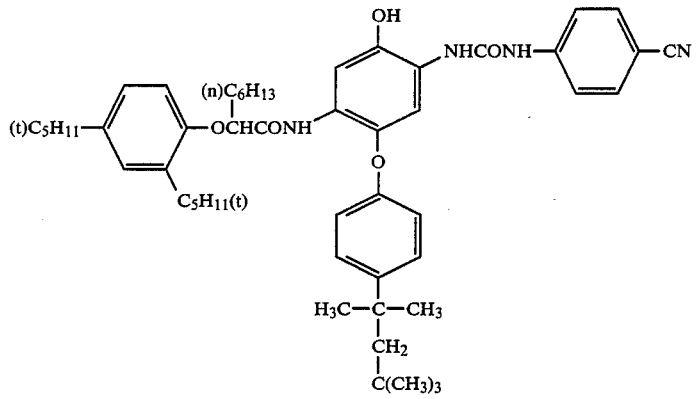
C-15
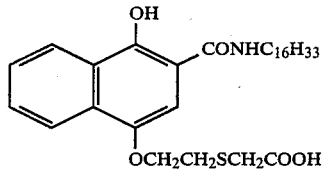
C-16
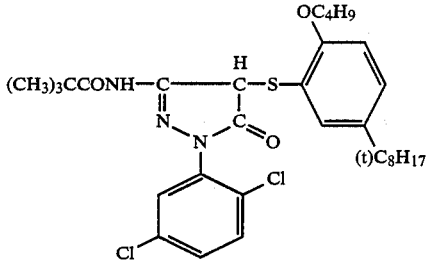
C-17
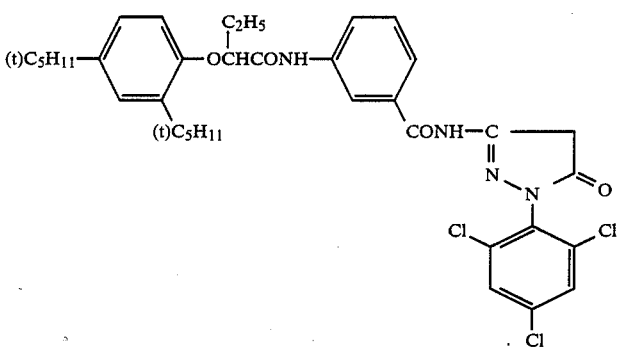
C-18
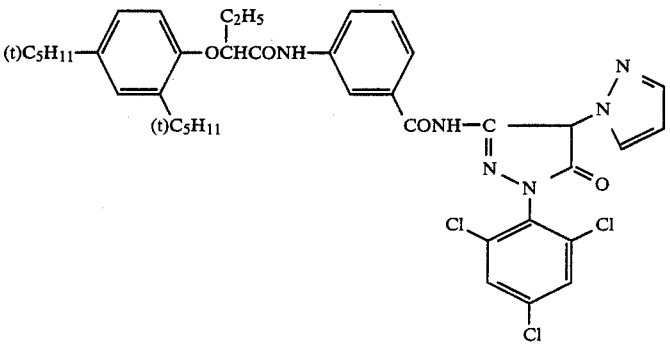

TABLE 2

| Sample | Maximum[1] Particle Size | Compound[2] | ΔD | MTF Value of Yellow Image (40 cycles/mm) | Exposure Latitude of Green-Sensitive Layer($L_G$) |
|---|---|---|---|---|---|
| 201 (Comparison) | 0.40 μm | C-12 | 0.18 | 0.57 | 3.0 |
| 203 (Comparison) | 0.29 μm | " | 0.15 | 0.55 | 3.5 |
| 205 (Comparison) | 0.21 μm | " | 0.12 | 0.53 | 3.8 |
| 207 (Comparison) | 0.17 μm | " | 0.10 | 0.52 | 4.2 |
| 202 (Comparison) | 0.40 μm | C-11 | 0.18 | 0.60 | 3.0 |
| 204 (Present Invention) | 0.29 μm | " | 0.18 | 0.60 | 3.5 |
| 206 (Present Invention) | 0.21 μm | " | 0.18 | 0.59 | 3.8 |
| 208 (Present Invention) | 0.17 μm | " | 0.17 | 0.59 | 4.2 |

[1]Maximum particle size of silver halide grains taking 30% by number of whole silver halide grains counted from the smallest.
[2]Compound for improving interimage effect.

From the results shown in Table 2, it can be seen that Samples 204, 206 and 208 according to the present invention are improved in sharpness without increase in color turbidity as well as expanded latitude in comparison with the samples (Samples 201, 203, 205, 207 and 202) other than the present invention.

EXAMPLE 4

In the case of using Compound (18), (19), (27), (34) and (35) according to the present invention in place of C-11 [Compound (26) according to the present invention] added to the third layer of Samples 202, 204, 206 and 208 in Example 3, respectively, equivalent results to Example 3 are obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one red-sensitive halide emulsion layer containing at least one cyan color forming coupler, at least one green-sensitive silver halide emulsion layer containing at least one magenta color forming coupler and at least one blue-sensitive silver halide emulsion layer containing at least one yellow forming coupler, wherein a silver halide emulsion contained in at least one of the silver halide emulsion layers is a fine grain silver halide emulsion in which 30% by number of the total number of whole silver halide grains have a diametr of not more than 0.3 μm, as a diameter of equivalent sphere, said fine grain silver halide emulsion being present in a layer containing a compound which denotes an interimage effect or in a layer which accepts an interimage effect or in a layer positioned between a layer which denotes an interimage effect and a layer which accepts an interimage effect, and the silver halide color photographic material contains a compound capable of releasing upon a reaction with an oxidation product of a developing agent a compound which is capable of releasing a development inhibitor upon a reaction with another molecule of an oxidation product of a developing agent.

2. A silver halide color photographic material as claimed in claim 1, wherein the compound capable of releasing upon a reaction with an oxidation product of a developing agent a compound which is capable of releasing a development inhibitor upon a reaction with another molecule of an oxidation product of a developing agent is a compound represented by formula (I):

$$A—PDI \quad (I),$$

wherein A represents a group capable of releasing PDI upon a reaction with an oxidation product of a developing agent; and PDI represents a group which forms a development inhibitor through a reaction with an oxidation product of a developing agent after being released from A.

3. A silver halide color photographic material as claimed in claim 2, wherein the compound represented by general formula (I) is a compound represented by formula (II):

$$A—(L_1)_v—B—(L_2)_w—DI \quad (II),$$

wherein A represents a group capable of releasing $(L_1)_v$—B—$(L_2)_w$—DI upon a reaction with an oxidation product of a developing agent; $L_1$ represents a group capable of releasing B—$(L_2)_w$—DI after being released from A; B represents a group capable of releasing $(L_2)_w$—DI upon a reaction with an oxidation product of a developing agent after being released from A—$(L_1)_v$; $L_2$ represents a group capable of releasing DI after being released from B; DI represents a development inhibitor; and v and w each represents 0 or 1.

4. A silver halide color photographic material as claimed in claim 3, wherein the group represented by A represents a coupler residual group or an oxidation reduction group.

5. A silver halide color photographic material as claimed in claim 4, wherein the coupler residual group represented by A is a yellow coupler residual group, a magenta coupler residual group, a cyan coupler residual group or a non-color forming coupler residual group.

6. A silver halide color photographic material as claimed in claim 4, wherein the coupler residual group represented by A is selected from an open-chain ketomethylene type coupler residual group, a 5-pyrazolone type coupler residual group, a pyrazoloimidazole type coupler residual group, a pyrazolotriazole type coupler residual group, a phenol type coupler residual group, a naphthol type coupler residual group, an indanone type coupler residual group and acetophenone type coupler residual group.

7. A silver halide color photographic material as claimed in claim 4, wherein the oxidation reduction group represented by A is a group represented by formula (III):

$$A_1—P—(X{=}Y)_n—Q—A_2 \qquad \text{(III)}$$

wherein P and Q each represents an oxygen atom or a substituted or unsubstituted imino group; at least one of n X's and n Y's represents a methine group having a group of $—(L_1)_v—B—(L_2)_w—DI$ as a substituent, and other X's and Y's each represent a substituted or unsubstituted methine group or a nitrogen atom; n represents an integer from 1 to 3 (n X's and n Y's may be the same or different); $A_1$ and $A_2$ each represents a hydrogen atom or a group capable of being eliminated with an alkali; and any two substituents of P, X, Y, Q, $A_1$ and $A_2$ may be divalent groups and connected to each other to form a cyclic structure.

8. A silver halide color photographic material as claimed in claim 7, wherein the cyclic structure formed by $(X{=}Y)_n$ is a benzene ring or a pyridine ring.

9. A silver halide color photographic material as claimed in claim 3, wherein the group represented by $L_1$ or $L_2$ is a group represented by formula (T-1):

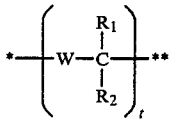

(T-1)

wherein a bond indicated by * denotes the position at which the group is connected to the left side group in formula (II); a bond indicated by ** denotes the position at which the group is connected to the right side group in the general formula (II); W represents an oxygen atom, a sulfur atom or a group of

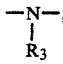

wherein $R_3$ represents an organic substituent; $R_1$ and $R_2$ each represents a hydrogen atom or a substituent; t represents 1 or 2, when t represents 2, two $R_1$'s and two $R_2$'s may be the same or different; and any two of $R_1$, $R_2$ and $R_3$ may combine with each other to form a cyclic structure.

10. A silver halide color photographic material as claimed in claim 3, wherein the group represented by $L_1$ or $L_2$ is a group represented by formula (T-2):

$$*—Nu—Link—E—** \qquad \text{(T-2)}$$

wherein a bond indicated by * denotes the position at which the group is connected to the left side group in formula (II); a bond indicated by  denotes the position at which the group is connected to the right side group in formula (II); Nu represents a nucleophilic group; E represents an electrophilic group which is able to cleave the bond indicated by  upon a nucleophilic attach of Nu; and Link represents a linking group which connects Nu with E in a stereochemical position capable of causing an intramolecular nucleophilic displacement action between Nu and E.

11. A silver halide color photographic material as claimed in claim 3, wherein the group represented by $L_1$ or $L_2$ is a group represented by formula (T-3):

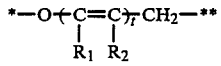

(T-3)

wherein a bond indicated by * denotes the position at which the group is connected to the left side group in formula (II); a bond indicated by ** denotes the position at which the group is connected to the right side group in formula (II); and $R_1$ and $R_2$ each represents a hydrogen atom or a substituent; t represents 1 or 2, when t represents 2, two $R_1$'s and two $R_2$'s may be the same or different; and $R_1$ and $R_2$ may combined with each other to form a cyclic structure.

12. A silver halide color photographic material as claimed in claim 3, wherein the group represented by $L_1$ or $L_2$ is a group represented by the following formulae:

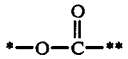

or

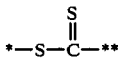

wherein a bond indicated by * denotes the position at which the group is connected to the left side group in formula (II); and a bond indicated by ** denotes the position at which the group is connected to the right side group in formula (II).

13. A silver halide color photographic material as claimed in claim 3, wherein the group represented by B is a group represented by a group capable of forming a coupler after being released from $A—(L_1)_v$ or a group capable of forming an oxidation-reduction group after being released from $A—(L_1)_v$.

14. A silver halide color photographic material as claimed in claim 13, wherein the group capable of forming a coupler is selected from a group which is formed by eliminating a hydrogen atom from a hydroxy group of a phenol type coupler and is connected to $A—(L_1)_v$ at the oxygen atom of the hydroxy group, and a group which is formed by eliminating a hydrogen atom from a hydroxy group of a 5-hydroxypyrazole which is a tautomer of a 5-pyrazolone type coupler and is connected to $A—(L_1)_v$ at the oxygen atom of the hydroxy group.

15. A silver halide color photographic material as claimed in claim 7, wherein the group capable of forming an oxidation reduction group is group represented by formula (B-1):

$$*—P—X'{=}Y'_nQ—A_2 \qquad \text{(B-1)}$$

wherein a bond indicated by * denotes the position at which the group is connected to $A—(L_1)_v—$; $A_2$, P, Q and n each has the same meaning as defined in formula (III); at least one of n X"s and n Y"s represents a methine group having a group of $(L_2)_w—DI$ as a substituent, and other X"s and Y"s each represent a substituted or unsubstituted methine group or a nitrogen atom; and any two substituents of $A_2$, P, Q, X' and Y' may be divalent groups and may combine with each other to form a cyclic structure.

16. A silver halide color photographic material as claimed in claim 3, wherein the group represented by DI is selected from a tetrazolylthio group, a benzimidazolylthio group, a benzothiazolylthio group, a benzoxazolylthio group, a benzotriazolyl group, a benzindazolyl group, a triazolylthio group, an imidazolylthio group, a thiadiazolylthio group, a thioether-substituted triazolyl group and an oxidiazolyl group, each of which may be substituted.

17. A silver halide color photographic material as claimed in claim 16, wherein a substituent for the group represented by DI is selected from a halogen atom, an aliphatic group, an alicyclic group, a nitro group, an acylamino group, an aliphatic or alicyclic oxycarbonyl group, an aromatic oxycarbonyl group, an imido group, a sulfonamido group, an aliphatic or alicyclic oxy group, an aromatic oxy group, an amino group, an imino group, a cyano group, an aromatic group, an acyloxy group, a sulfonyloxy group, an aliphatic or alicyclic thio group, an aromatic thio group, an aromatic oxysulfonyl group, an aliphatic or alicyclic oxysulfonyl group, an aliphatic or alicyclic oxycarbonylamino group, an aromatic oxycarbonylamino group, an aliphatic or alicyclic oxycarbonyloxy group, a heterocyclic oxycarbonyl group, a heterocyclic oxy group, a sulfonyl group, an ocyl group, a ureido group, a heterocyclic group, a hydroxy group.

18. A silver halide color photographic material as claimed in claim 3, wherein the compound represented by formula (II) is a polymer derived from a monomer compound represented by formula (P-1) described below and having a recurring unit represented by the general formula (P-2) described below or may be a copolymer of the above described monomer compound and at least one non-color forming monomer containing at least one ethylene group which does not have an ability to couple with an oxidation product of an aromatic primary amione developing agent:

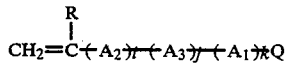
(P-1)

and

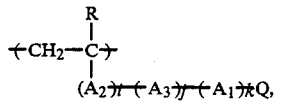
(P-2)

wherein R represents a hydrogen atom, a lower alkyl group having from 1 to 4 carbon atoms or a chlorine atom; $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —S—, —NH— or —O—; $A_2$ represents —CONH— or —COO—; $A_3$ represents a substituted or unsubstituted alkylene group having from 1 to 10 carbon atoms, a substituted or unsubstituted aralkylene group, or a substituted or unsubstituted arylene group; Q represents a group of the compound represented by the general formula (II); and i, j and k each represents 0 or 1 excluding the case that i, j, k are simultaneously 0.

19. A silver halide color photographic material as claimed in claim 18, wherein the non-color forming ethylenic monomer is selected from an acrylic acid, an ester derived from an acrylic acid, an amide derived from an acrylic acid, methylenebisacryamide, a vinyl ester, an acrylonitrile, an aromatic vinyl compound, a maleic acid derivative and a vinylpyridine.

20. A silver halide color photographic material as claimed in claim 3, wherein A represents a coupler residual group represented by the following formula (Cp-1), (Cp-2), (Cp-3), (Cp-4), (Cp-5), (Cp-6), (Cp-7), (Cp-8) or (Cp-9):

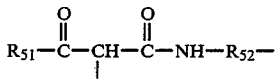
(Cp-1)

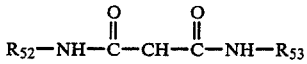
(Cp-2)

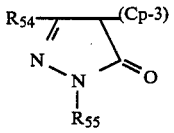
(Cp-3)

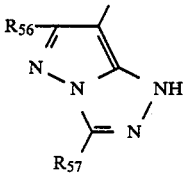
(Cp-4)

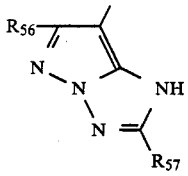
(Cp-5)

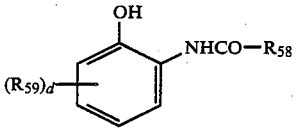
(Cp-6)

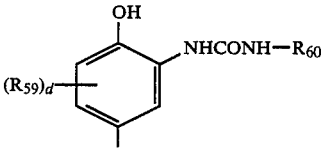
(Cp-7)

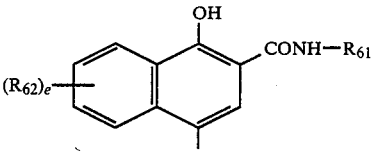
(Cp-8)

-continued (Cp-9)

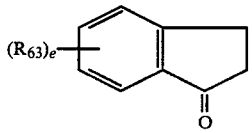

wherein $R_{41}$ represents an aliphatic group, an alicyclic group, an aromatic group or a heterocyclic group; $R_{42}$ represents an aromatic group or a heterocyclic group; and $R_{43}$, $R_{44}$ and $R_{45}$ each represents a hydrogen atom, an aliphatic group, an alicyclic group, an aromatic group or a heterocyclic group;

$R_{51}$ represents a group as defined for $R_{41}$;

$R_{52}$ and $R_{53}$ each represents a group as defined for $R_{42}$;

$R_{54}$ represents a group as defined for $R_{41}$, a group of $R_{41}CON(R_{43})$—, a group of $R_{41}N(R_{43})$—, a group of $R_{41}SO_2N(R_{43})$—, a group of $R_{41}S$—, a group of $R_{43}O$—, a group of $R_{45}NCON(R_{43})(R_{44})$—, a group of $R_{41}OOC$—, a group of $R_{44}NCO(R_{43})$— or a group of N=C—;

$R_{55}$ represents a group as defined for $R_{41}$;

$R_{56}$ and $R_{57}$ each represents a group as defined for $R_{43}$, a group of $R_{41}S$—, a group of $R_{41}O$—, a group of $R_{41}CON(R_{43})$—, a group of $R_{41}N(R_{43})$—, a group of $R_{43}NCON(R_{44})(R_{45})$— or a group of $R_{41}SO_2N(R_{43})$—;

$R_{58}$ represents a group as defined for $R_{41}$;

$R_{59}$ represents a group as defined for $R_{41}$, a group of $R_{41}CON(R_{43})$—, a group of $R_{41}OCON(R_{43})$—, a group of $R_{41}SO_2N(R_{43})$—, a group of $R_{43}NCON(R_{44})(R_{45})$—, a group of $R_{43}NSO_2N(R_{44})(R_{45})$—, a group of $R_{41}O$—, a group of $R_{41}S$—, a halogen atom or a group of $R_{41}N(R_{43})$—;

d represents an integer from 0 to 3; group and connected with each other to form a cyclic structure;

$R_{60}$ represents a group as defined for $R_{41}$;

$R_{61}$ represents a group as defined for $R_{41}$;

$R_{62}$ represents a group as defined for $R_{41}$; a group of $R_{41}CONH$—, $R_{41}OCONH$—, a group of $R_{41}SO_2NH$—, a group of $R_{43}NCON(R_{44})(R_{45})$—, a group of $R_{43}NSO_2N(R_{44})(R_{45})$—, a group of $R_{43}O$—, a group of $R_{41}S$—, a halogen atom or a group or $$R_{41}\underset{\underset{R_{43}}{|}}{N}—;$$

$R_{63}$ represents a group as defined for $R_{41}$, a group of $$R_{41}CO\underset{\underset{R_{44}}{|}}{N}—,$$

a group of $$R_{41}N\underset{\underset{R_{44}}{|}}{C}O—,$$

a group of $$R_{41}SO_2\underset{\underset{R_{44}}{|}}{N}—,$$

a group of $$R_{41}N\underset{\underset{R_{44}}{|}}{S}O_2—,$$

a group of $R_{41}SO_2$—, a group of $R_{41}OCO$—, a group of $R_{41}OSO_2$—, a halogen atom, a nitro group, a cyano group or a group of $R_{43}CO$—; and e represents an integer of from 0 to 4.

21. A silver halide color photographic material as claimed in claim 7, wherein P and Q each represents a substituted or unsubstituted imino group.

22. A silver halide color photographic material as claimed in claim 7, wherein P and Q each represents an imino group substituted with a sulfonyl group or an acyl group.

23. A silver halide color photographic material as claimed in claim 22, wherein P and Q represents a group represented by the following formula (N-1) or (N-2):

$$*—\underset{\underset{SO_2—G}{|}}{N}—** \qquad \text{(N-1)}$$

$$*—\underset{\underset{CO—G}{|}}{N}—** \qquad \text{(N-2)}$$

wherein a bond indicated by * denotes the position at which the group is connected to $A_1$ or $A_2$; a bond indicated by ** denotes the position at which the group is connected to one of the free bonds of $—(X{=}Y)_n$; and G represents an aliphatic or alicyclic group containing from 1 to 32 carbon atoms which may be substituted, an aromatic group containing from 6 to 10 carbon atoms which may be substituted or a 4-membered, 5-membered, 6-membered or 7-membered heterocyclic group containing, as a hetero atom, a nitrogen atom, a sulfur atom or an oxygen atom.

24. A silver halide color photographic material as claimed in claim 7, wherein P represents an oxygen atom and $A_2$ represents a hydrogen atom.

25. A silver halide color photographic material as claimed in claim 7, wherein X and Y each represents a substituted or unsubstituted methine group, except that at least one of X or Y represents a methine group having a group of $—(L_1)_v—B—(L_2)_w—DI$ as a substituent.

26. A silver halide color photographic material as claimed in claim 7, wherein the group represented by formula (II) is a group represented by formula (IV) or (V):

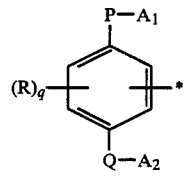

(IV)

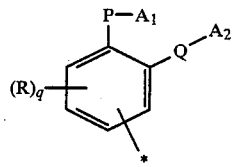

(V)

wherein a bond indicated by * denotes the position at which the group is connected to $—(L_1)_v—B—(L_2)_w—DI$; P, Q, $A_1$ and $A_2$ each has the same meaning as defined in formula (III); R represents a substituent; q represents an integer of 0, 1, 2 or 3; and when q represents 2 or 3, two or three R's may be the same or different, or when two R's represent substituents positioned on the adjacent two carbon atoms, they may be divalent groups and connected to each other to form a cyclic structure.

27. A silver halide color photographic material as claimed in claim 26, wherein the substituent represented by R is selected from an aliphatic group, an alicyclic group, an aromatic group, a halogen atom, an alkoxy group, an alkylthio group, an aryloxy group, an arylthio group, a carbamoyl group, an alkoxycarbonyl group, an aryloxycarbonyl group, a sulfonyl group, a sulfamoyl group, an acylamino group, a sulfanamido group, an acyl group, a nitroso group, an acyloxy group, a ureido group, a nitro group, a cyano group, a heterocyclic group, a hydroxy group, a carboxy group, an alkoxycarbonylamino group, a sulfo group, an amino group, an arylamino group, an aliphatic amino group, a sulfinyl group, a sulfamoylamino group, a thioacyl group, a thioureido group, a heterocyclic thio group, an imido group and a heterocyclic amino group.

28. A silver halide color photographic material as claimed in claim 15, wherein P represents an oxygen atom and Q represents an oxygen atom or one of the following groups:

$$*—\underset{\underset{SO_2—G}{|}}{N}—** \quad \text{and} \quad *—\underset{\underset{CO—G}{|}}{N}—**$$

wherein a bond indicated by * denotes the position at which the group is connected to $—(X'{=}Y')_n—$; a bond indicated by ** denotes the position at which the group is connected $A_2$; and G represents an aliphatic or alicyclic group containing from 1 to 32 carbon atoms which may be substituted, an aromatic group containing from 6 to 10 carbon atoms which may be substituted or a 4-membered, 5-membered, 6-membered or 7-membered heterocyclic group containing, as a hetero atom, a nitrogen atom, a sulfur atom or an oxygen atom.

29. A silver halide color photographic material as claimed in claim 26, wherein the group represented by B is represents a group represented by formula (B-2) or (B-3):

(B-2)

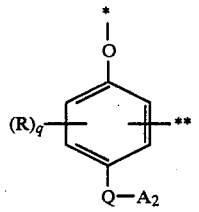

(B-3)

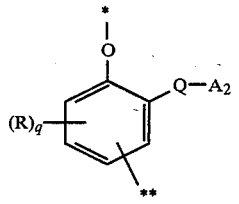

wherein a bond indicated by * denotes the position at which the group is connected to A—$(L_1)_v$—; a bond indicated by ** denotes the position at which the group is connected to —$(L_2)_w$—DI; and R, q, Q and $A_2$ each has the same meanings as defined in formula (IV) or (V).

30. A silver halide color photographic material as claimed in claim 29, wherein the substituent represented by R is selected from an aliphatic group, an alicyclic group, an alkoxy group, an alkylthio group, an alkoxycarbonyl group, an aryloxycarbonyl group, a carbamoyl group, a sulfonamido group, an acylamino group, a heterocyclic thio group, a hydroxy group, and an aromatic group.

31. A silver halide color photographic material material as claimed in claim 3, wherein both v and w are 0.

32. A silver halide color photographic material as claimed in claim 3, wherein the group represented by A is a coupler residual group.

33. A silver halide color photographic material as claimed in claim 3, wherein the development inhibitor represented by DI is a development inhibitor which is a compound having a development inhibiting function when being released as DI and capable of being decomposed, or changed into, a compound having substantially no effect on photographic properties after being discharged into a color developing solution.

34. A silver halide color photographic material as claimed in claim 4, wherein the development inhibitor represented by DI is a group represented by the following formula (D-1), (D-2), (D-3), (D-4), (D-5), (D-6), (D-7), (D-8), (D-9), (D-10) or (D-11):

(D-1)

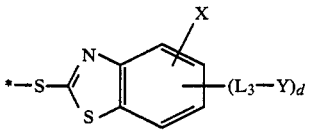

-continued (D-2)

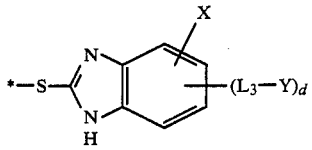

(D-3)

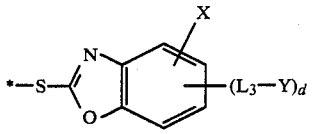

(D-4)

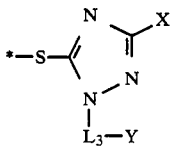

(D-5)

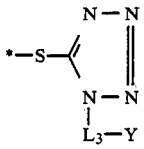

(D-6)

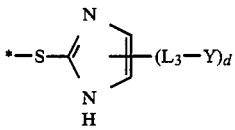

(D-7)

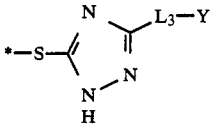

(D-8)

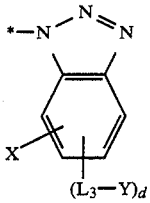

(D-9)

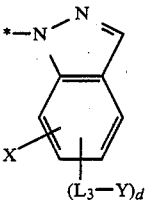

(D-10)

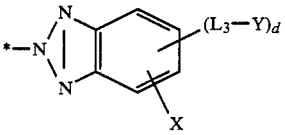

(D-11)

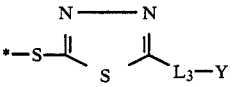

wherein a bond indicated by * denotes the position at which the group is connected to $A—(L_1)_v—B—(L_2)_w—$; X represents a hydrogen atom or a substituent; d represents 1 or 2; $L_3$ represents a group containing a chemical bond which is capable of being cleaved in a developing solution; and Y represents a substituent capable of generating the development inhibiting function and is selected from an aliphatic group, an alicyclic group, an aromatic group or a heterocyclic group.

35. A silver halide color photographic material as claimed in claim 34, wherein the substituent represented by X is selected from an aliphatic group, an alicyclic group, an acylamino group, an alkoxy group, a halogen atom, a nitro group, and a sulfonamido group.

36. A silver halide color photographic material as claimed in claim 34, wherein the chemical bond included in $L_3$ is selected from —COO—, —NHCOO—, $—SO_2O—$, $—OCH_2CH_2SO_2—$, $$-\underset{\underset{O}{\|}}{OCO}-, \quad \text{and} \quad -\underset{\underset{O}{\|}}{NHC}\underset{\underset{O}{\|}}{CO}-.$$

* * * * *